US011660627B2

(12) United States Patent
Bartolucci

(10) Patent No.: US 11,660,627 B2
(45) Date of Patent: May 30, 2023

(54) RECYCLABLE PUMP DISPENSER

(71) Applicant: The Procter & Gamble Company, Cincinnati, OH (US)

(72) Inventor: Stefano Bartolucci, Singapore (SG)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/519,621

(22) Filed: Nov. 5, 2021

(65) Prior Publication Data

US 2022/0184650 A1 Jun. 16, 2022

Related U.S. Application Data

(60) Provisional application No. 63/125,699, filed on Dec. 15, 2020.

(51) Int. Cl.
*B05B 11/00* (2023.01)
*B05B 11/10* (2023.01)

(52) U.S. Cl.
CPC ..... *B05B 11/1077* (2023.01); *B05B 11/1001* (2023.01); *B05B 11/1059* (2023.01)

(58) Field of Classification Search
CPC ..... B05B 11/3077; B05B 11/3001; B05B 11/3059; B05B 11/3052; B05B 11/3047; B05B 11/3067; B05B 11/306; B05B 11/3074
See application file for complete search history.

(56) References Cited

U.S. PATENT DOCUMENTS

| | | | | |
|---|---|---|---|---|
| 4,046,495 | A * | 9/1977 | Grimm, Jr. | B05B 11/0075 417/268 |
| 4,057,176 | A * | 11/1977 | Horvath | B05B 11/3059 222/321.9 |
| 5,425,477 | A * | 6/1995 | Montaner | B05B 11/3011 222/383.1 |
| 8,720,746 | B2 * | 5/2014 | Blake | B05B 9/0883 222/336 |
| 9,718,073 | B2 | 8/2017 | Kang | |
| 9,937,509 | B2 | 4/2018 | Dejong | |
| 10,138,971 | B1 | 11/2018 | Deman et al. | |
| 10,335,816 | B1 | 7/2019 | Arminak | |
| 2015/0136810 | A1 | 5/2015 | Ding | |
| 2017/0128966 | A1 * | 5/2017 | Law | B05B 11/306 |
| 2017/0326567 | A1 | 11/2017 | Santagiuliana | |
| 2019/0054486 | A1 * | 2/2019 | Deman | B05B 11/3077 |
| 2019/0203792 | A1 | 7/2019 | Deman et al. | |

(Continued)

FOREIGN PATENT DOCUMENTS

| | | |
|---|---|---|
| CA | 2698915 C | 6/2017 |
| CN | 1077239 C | 1/2002 |

(Continued)

OTHER PUBLICATIONS

PCT Search Report and Written Opinion for PCT/US2021/063200 dated Apr. 4, 2022, 16 pages.

*Primary Examiner* — Bob Zadeh
(74) *Attorney, Agent, or Firm* — Jay A. Krebs

(57) ABSTRACT

A pump dispenser where the pump assemblies does not require disassembly to be recycled in current recycling streams. The pump assembly can include a plastic spring that does not lose stiffness over time and does not interact with the liquid product.

19 Claims, 23 Drawing Sheets

(56) References Cited

U.S. PATENT DOCUMENTS

| | | | | |
|---|---|---|---|---|
| 2020/0047204 | A1 | 2/2020 | Knight | |
| 2020/0346235 | A1 | 11/2020 | Knight | |
| 2021/0291212 | A1* | 9/2021 | Liang | B05B 11/3074 |
| 2022/0184650 | A1* | 6/2022 | Bartolucci | B05B 11/306 |

FOREIGN PATENT DOCUMENTS

| | | | |
|---|---|---|---|
| CN | 109027080 | A | 12/2018 |
| EP | 1364719 | A1 | 11/2003 |
| EP | 1315579 | B1 | 5/2004 |
| EP | 3102336 | B1 | 2/2020 |
| JP | 2002200443 | A | 7/2002 |
| JP | 2004202398 | A | 7/2004 |
| JP | 2008284410 | A | 11/2008 |
| KR | 100203892 | B1 | 6/1999 |
| KR | 20040062301 | A | 7/2004 |
| KR | 100494351 | B1 | 6/2005 |
| WO | 9420221 | A1 | 9/1994 |
| WO | 2004016517 | A1 | 2/2004 |
| WO | 2019136004 | A1 | 7/2019 |

* cited by examiner

RECYCLABLE PUMP DISPENSER

FIELD OF THE INVENTION

A pump dispenser, in particular a pump dispenser has a pump assembly where used pump assembly does not require disassembly to be recycled in current recycling streams.

BACKGROUND OF THE INVENTION

Pump dispensers are commonly used for dispensing various liquids including lotions, foams, gels, etc. The pump assembly dispenses liquid when a user pushes down on (or primes) the pump head, the piston puts pressure on the spring and moves a ball valve upward taking some liquid product with it. When the pump head is released, the piston and spring return to the resting positions, sealing off the housing chamber to stop liquid from flowing back up into the bottle. Most pump dispenser components are made from polyethylene (PE) or polypropylene (PP): these can generally be recycled into a single recycling stream within acceptable contaminant limits. However, the presence of the steel spring in the pump assembly can make it difficult to recycle the pump dispenser in current recycling streams. Thus, it can be desirable to make a pump dispenser that comprises only recyclable plastics from the same material recycling class, as defined by the Society of Plastics Industry, including a plastic spring.

However, replacing a steel spring to a recyclable plastic spring made from polyethylene (PE) or polypropylene (PP) is not a simple substitution. Plastic springs have different mechanical and chemical properties as compared to steel springs. For instance, PE or PP has an elastic modulus 50× to 150× lower than steel. Plastic springs also lose stiffness over time by creep forces, cycling loads and/or can react with the liquid product.

There are some all-plastic springs available today. However, in order to prevent the spring from being in contact with the product inside the bottle, the spring is built into the pump head, which can significantly increase the height of the pump assembly. When selling beauty and personal care products in retail stores, the shelf height is generally set by the retailer. Therefore, in order to use currently available all-plastic, recyclable springs, the size and/or shape of the entire lineup of products would have to be significantly altered. This is implausible, especially for products that have iconic packaging.

Accordingly, there is a need for a pump dispenser that has a pump assembly where used pump assemblies do not require disassembly to be recycled in current recycling streams. In particular, there is a need for a pump assembly with a plastic spring where the spring does not lose stiffness over time and does not interact with the liquid product.

SUMMARY OF THE INVENTION

A pump dispenser comprising: (a) a bottle comprising a neck having a neck landing zone; wherein the bottle consists essentially of polypropylene, polyethylene, or polyethylene terephthalate; (b) a pump assembly comprising: (i) a pump head having a cavity therein wherein the pump head is adapted to receive an end of a first stem; (ii) a closure coupled to the neck of the body; (iii) the first stem comprising an end rigidly connected to the pump head, a hollow inner cavity fluidly connected to the pump head cavity, and an outer surface having a first snap and a second snap; wherein the first stem is configured to move relative to a second stem; (iv) the second stem at least partially enclosing the first stem; the second stem having a hollow inner channel in fluid communication with the first stem inner cavity; wherein the second stem comprises a platform and a cantilever; wherein the cantilever interlocks with the first snap in a locked storage position and the second snap in a dispense ready position; (v) a plastic spring at least partially surrounding the second stem; (vi) a housing at least partially surrounding the spring; the housing comprising a dosing chamber having a hollow interior wherein the hollow interior is in fluid communication with the inner channel of the second stem; wherein the pump assembly consists essentially of polypropylene or polyethylene.

A pump dispenser comprising: (a) a bottle comprising a neck wherein the bottle contains a fluid product; (b) a pump assembly in a locked storage configuration comprising: (i) a pump head having a cavity therein wherein the pump head is adapted to receive an end of a first stem; (ii) a closure coupled to the neck of the body; (iii) the first stem comprising an end rigidly connected to the pump head, a hollow inner cavity fluidly connected to the pump head cavity, and an outer surface having a first snap; wherein the first stem is configured to move relative to a second stem; (iv) the second stem at least partially enclosing the first stem; the second stem having a hollow inner channel in fluid communication with the first stem inner cavity; wherein the second stem comprises a platform and a cantilever; wherein the cantilever interlocks with the first snap; (v) a plastic spring at least partially surrounding the second stem; wherein there is no preload on the spring and the spring is adjacent to and spaced from the platform; (vi) a housing at least partially surrounding the spring; the housing comprising an inner wall and a dosing chamber having a hollow interior wherein the hollow interior is in fluid communication with the inner channel of the second stem; wherein the pump dispenser comprises at least 80% of one kind of recyclable plastic selected from the group consisting of polyethylene, polypropylene, polyethylene terephthalate, and combinations thereof.

BRIEF DESCRIPTION OF THE DRAWINGS

While the specification concludes with claims particularly pointing out and distinctly claiming the subject matter of the present invention, it is believed that the invention can be more readily understood from the following description taken in connection with the accompanying drawings, in which:

DETAILED DESCRIPTION OF THE INVENTION

Figure 1:
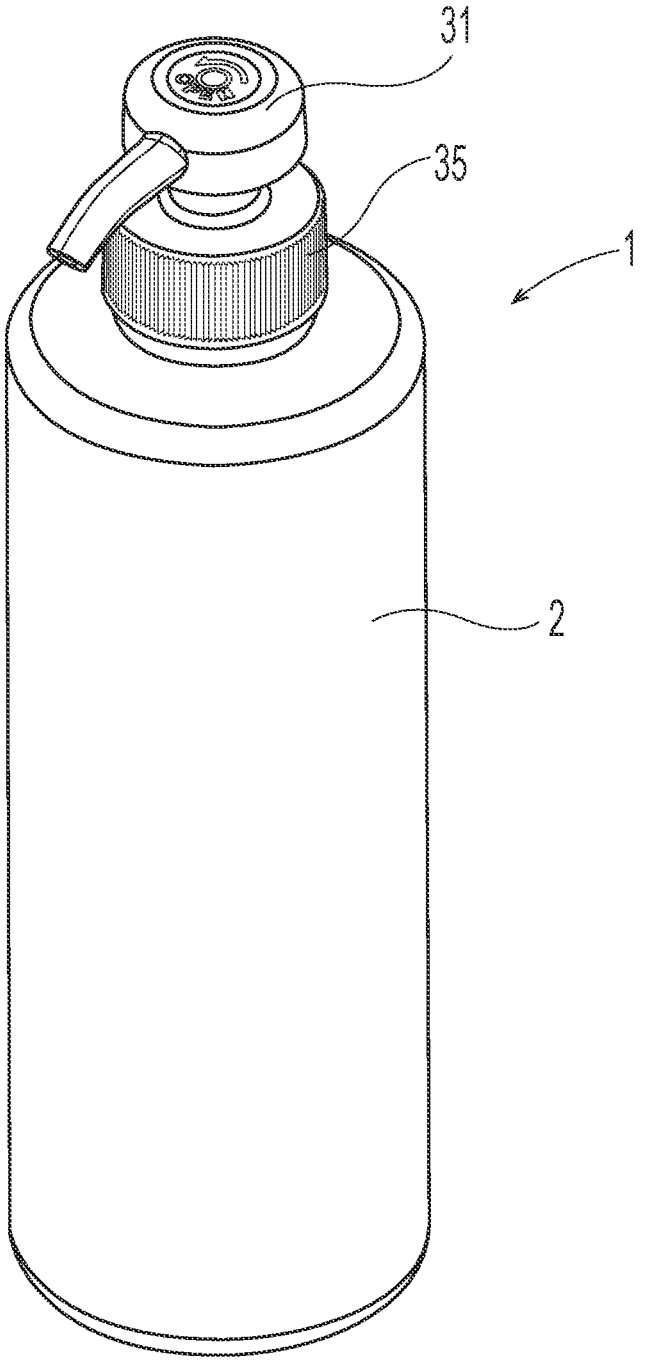
FIG. 1 is a perspective view of a pump dispenser.

Consumers may prefer dispensing some liquid beauty and personal care products, such as shampoo, conditioner, and body wash, by using a pump dispenser with a pump assembly. However, most pump assemblies are made from a combination of plastics and/or include a steel spring. Steel springs are common in pump dispensers because they are inexpensive, relatively stiff with little deformation over time while still being relatively easy to actuate, and it generally does not react with most liquid beauty and personal care products. However, pump assemblies that include a steel spring and/or different kinds of plastic can be hard to recycle without disassembling the pump assembly.

Therefore, there is a need for a pump dispenser where the bottle and the pump assembly are made from plastic that is recyclable in a current plastic recycling stream. For example, the bottle can be designed to be compatible with a current polyethylene terephthalate (PET), PP, or PE recycling stream and the pump assembly can be designed to be compatible with the current PE or PP recycling stream. The pump dispenser and/or pump assembly can contain 80% or more, alternatively 85% or more, alternatively 88% or more, alternatively 90% or more, alternatively 92% or more, alternatively 95% or more, alternatively 97% or more, and alternatively 99% or more of one kind of recyclable plastic. The pump dispenser can consist of or can consist essentially of PE or PP. The bottle can consist of or consist essentially of PE, PP, or PET. The terms "consisting essentially of PE," "consisting essentially of PP," or "consisting essentially of PET," may mean including the PE, PP, or PET and possibly a pigment, but not including other plastics, such as high-density polyethylene (HDPE), low-density polyethylene (LDPE), linear low-density polyethylene (LLDPE), and medium-density polyethylene (MDPE), except for amounts that are less than the threshold for the current PP, PE, or PET recycling stream.

Furthermore, during shipping, handling, and storage before the first use, the pump assembly of current pump dispensers is in a locked storage configuration where the spring is compressed, and liquid product cannot be dispensed through the pump assembly. Since a steel spring has a relatively high elastic modulus, when the pump head is turned and the pump assembly is unlocked, the spring expands to its original, resting state without significant deformation. However, plastic springs have an elastic modulus that is 50× to 150× lower than steel and if they are subjected to this compressive force in the locked storage configuration, there can be significant deformation and the pump assembly will not work as well.

Furthermore, in pump assemblies with metal springs, the spring is in contact with the liquid product during use. However, plastic, such as PP and PE, can be more reactive than steel to some chemistries, which can cause the spring to have a modulus change (either stiffening or loosening) or even stress-breaking by the interaction between the spring material and the liquid product. In addition, material from the plastic spring can leach into the liquid product, compromising the safety and efficacy of the product.

Currently, there are some pump assemblies with PE or PP springs. However, in order to prevent the plastic spring from losing stiffness, when the pump head is locked and/or reacting with the liquid product the spring is built into the pump head uncompressed. Unless the bottle height is reduced, the pump dispenser can be too tall for the retail shelves when it is in the storage configuration for shipping, handling, and storage.

The pump dispenser in the storage configuration can fit on a standard store shelf without redesigning the bottle. The spring may not be in contact with the liquid product when it is in the storage configuration to avoid the plastic leaching into the liquid product and/or the spring cracking due to environmental stress. The pump head can have a height, as measured from the neck landing zone to the top of the pump head when locked, in the locked storage configuration of less than 40 mm, alternatively less than 35 mm, alternatively less than 30 mm, alternatively of less than 29 mm, alternatively less than 28 mm, alternatively less than 27 mm, alternatively less than 25 mm, alternatively less than or equal to 23 mm, alternatively less than 22 mm, and alternatively less than or equal to 20 mm. The pump head can have a height, as measured from the neck landing zone to the top of the pump head when locked, in the locked storage configuration can be from about 10 mm to about 38 mm, alternatively from about 15 mm to about 35 mm, alternatively from about 18 mm to about 30 mm, and alternatively from about 20 mm to about 25 mm.

FIG. 1 is a perspective view of pump dispenser 1 that includes bottle 2 coupled to pump assembly 3 in the locked storage position. The pump assembly includes pump head 31 and closure 35. More specifically, closure 35 is coupled (e.g. threadingly engaged) to the neck of bottle 2.

Figure 2:
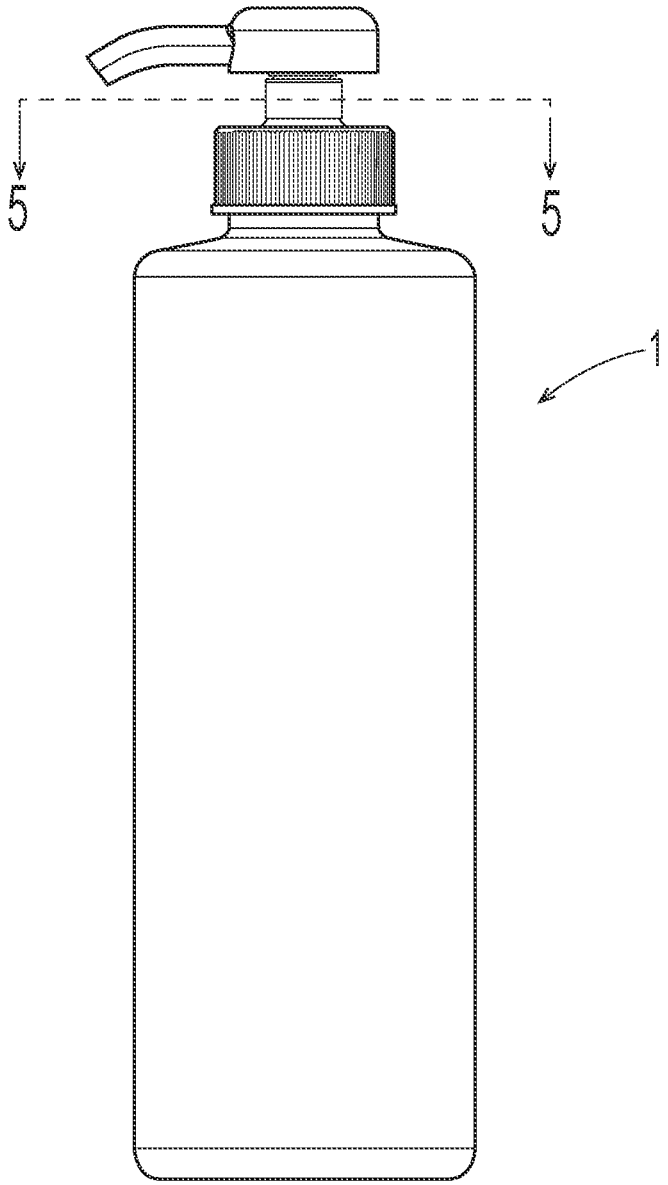
FIG. 2 is a side view of the pump dispenser of FIG. 1 in the locked storage configuration.

FIG. 2 is a side view of the pump dispenser of FIG. 1 in the locked storage configuration.

Figure 3:
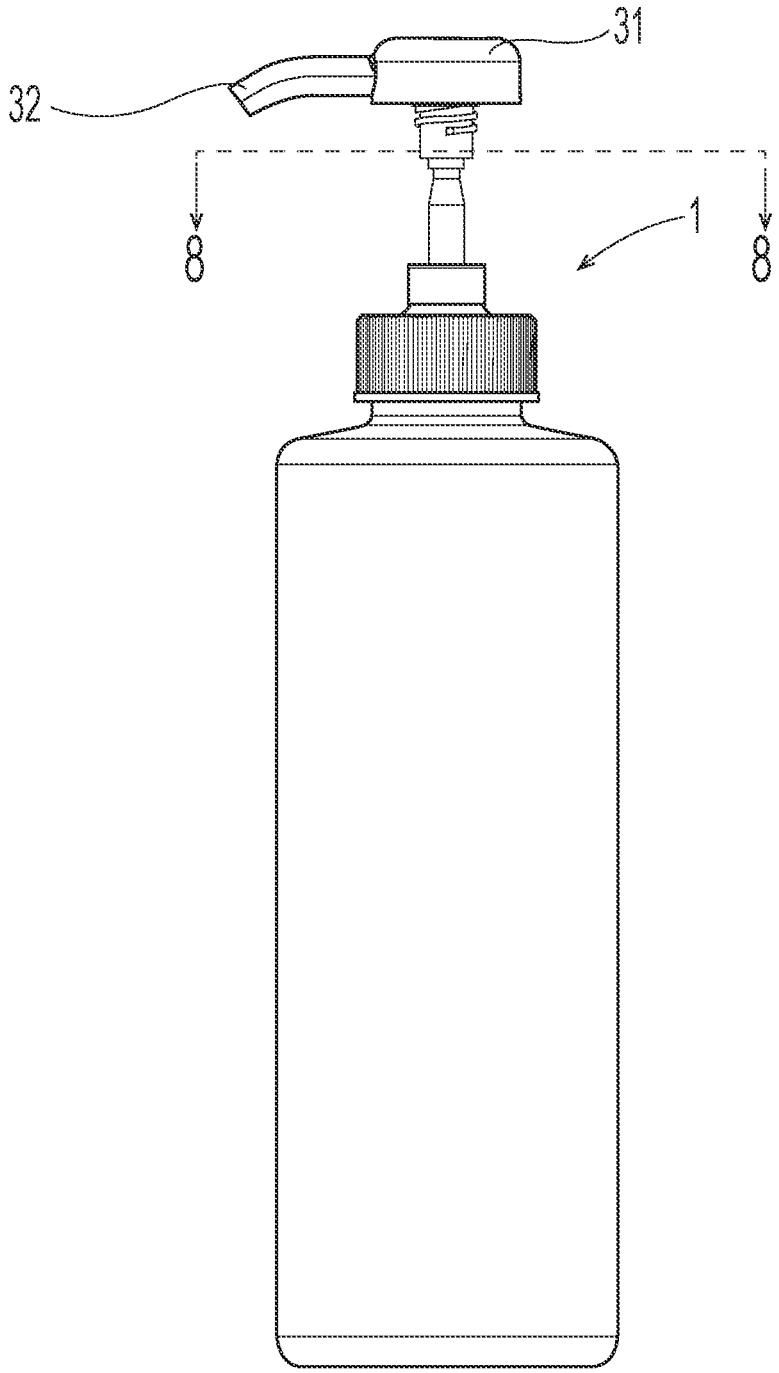
FIG. 3 is a side view of the pump dispenser of FIG. 1 in the dispense ready position.

FIG. 3 is a side view of the pump dispenser of FIG. 1 in the dispense ready position. A user can use one hand to press downward on pump head 31 in order to dispense liquid products from spout 32 into the other hand or onto an implement, such as a sponge, washcloth, or mesh pouf. The liquid amount dispensed in one pumping action (i.e. dosage per stroke) can be dispense from about 2 to about 6 ml, alternatively from about 2.5 to about 5.5 ml, alternatively from about 3 to about 5 ml, and alternatively from about 3.6 to about 4.4 ml of liquid product. The average peak force to actuate at 90% stroke can be less than 45 N, alternatively less than 40 N, alternatively less than 35 N, and alternatively less than or equal to 30 N as determined by the Average Peak Force to Actuate Test Method, described hereafter, where the liquid tested is water, a personal care composition (e.g. shampoo, conditioner, body wash, liquid hand soap) with a viscosity from about 1 cSt to about 2,000,000 cSt as measured according to the viscosity test method described herein.

Figure 4:
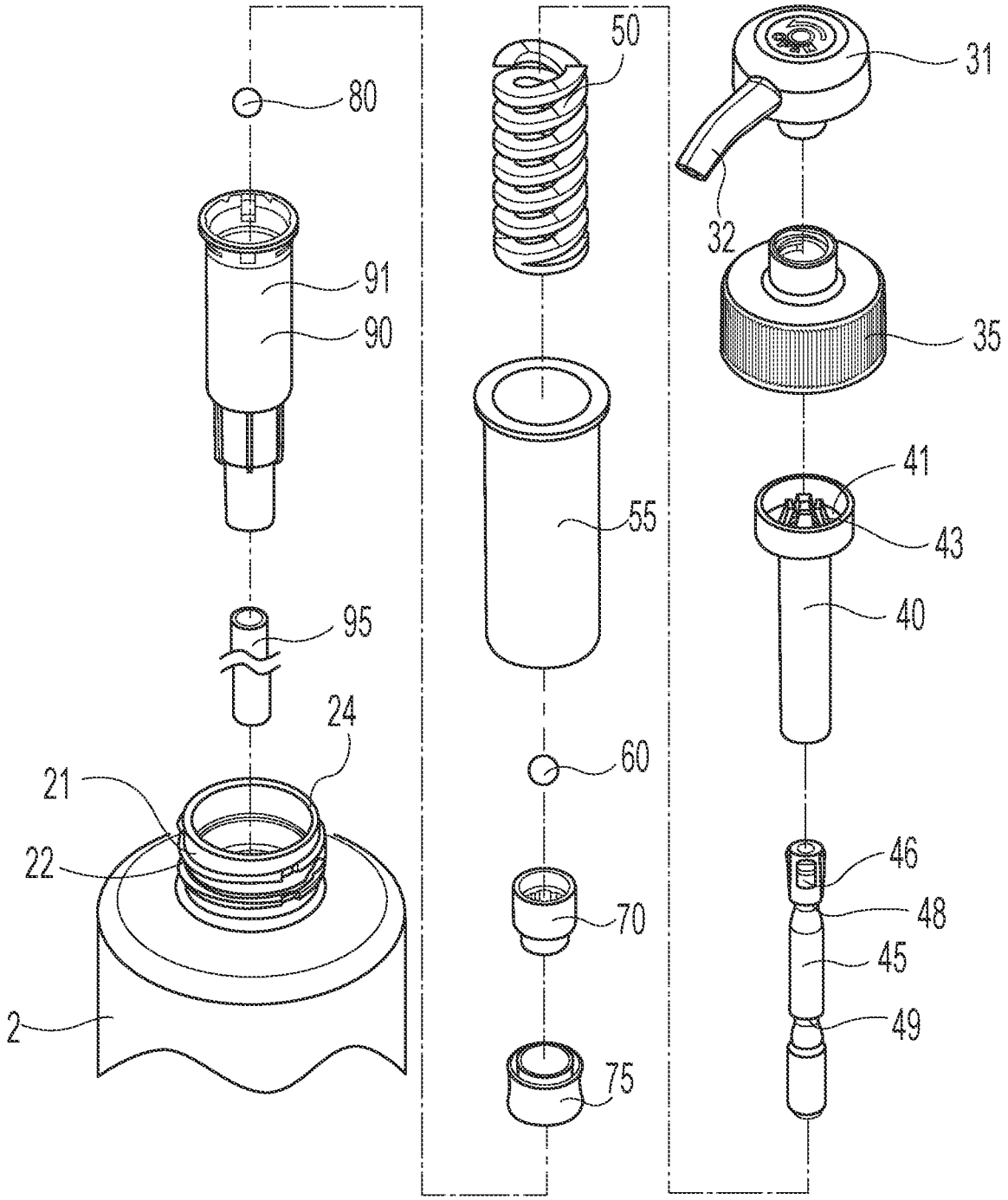
FIG. 4 is an exploded perspective view of the pump dispenser of FIG. 1.

FIG. 4 is an exploded perspective view of the pump dispenser of FIG. 1. The pump dispenser can have bottle 2 with neck 21 having threads 22 and neck landing zone 24 and a pump assembly. The pump assembly can comprise pump head 31 having spout 32; closure 35; second stem 40 having platform 41 and cantilevers 43; first stem 45 having snaps 46 adapted to rigidly connect with pump head 31 and snaps 48 and 49 adapted to snap-fit to the second stem in the locked storage position and the dispense ready position, respectively; spring 50; first housing 55; first ball 60; sub-stem 70; piston 75; second ball 80; second housing 90 having dosing chamber 91; and dip tube 95. The pump assembly can be made of PE or PP. In one example, the pump assembly can be compatible with the current PP recycling stream and the bottle can be recyclable with the current PET or PP recycling streams. In another example, the pump assembly can be compatible with the current PE recycling stream and the bottle can be compatible with the PE or PET recycling streams.

Figure 5:
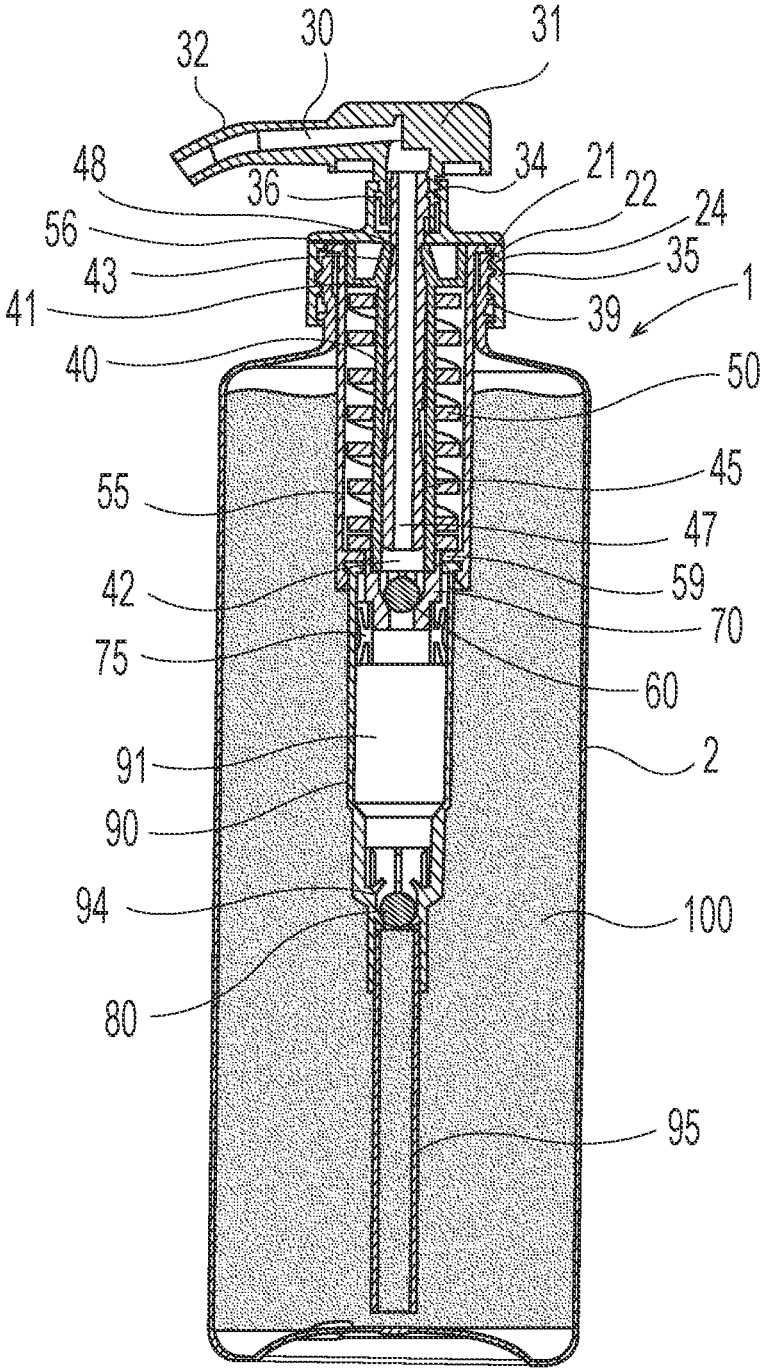
FIG. 5 is a cross-sectional view of the pump dispenser of FIG. 2.

FIG. 5 is a cross section of the pump dispenser of FIG. 2 in the locked storage configuration, which occurs prior to first actuation and use. Pump dispenser 1 can include bottle 2 and pump assembly 3. Pump assembly 3 is attached to bottle 2 by closure 35 which includes threads 39 that can engage mating threads 22 which are located on neck 21 of bottle 2. In some examples, the closure can carry a chaplet that can limit water ingress into the bottle opening. If present, the chaplet can be connected to the closure by any suitable means including, but not limited to, a threaded connection to a surface of the closure, in particular a surface near or at the top of the closure. The chaplet can be the same material as the pump assembly.

Pump assembly 3 includes pump head 31 that can be rigidly connected to first stem 45. First stem 45 can be rigidly connect to pump head 31 via snaps. First stem 45 can have a hollow first stem inner cavity 47 that is fluidly connected to cavity 30 of pump head 31.

Second stem 40 can have a channel 42 configured to receive first stem 45, while allowing vertical movement of first stem 45. The outer surface of first stem and the inner surface of the second stem are slidably engaged such that substantially no liquid product is between the inner surface of the second stem and the outer surface of the first stem. Channel 42 can be fluidly connected to first stem cavity 47. Second stem 40 can include cantilevers 43, which are configured to engage the first snaps 48 when the pump is in the locked storage configuration, and platform 41, which is adapted to compress spring 50 during actuation. However, in the locked storage configuration, platform 41 is adjacent to and spaced from spring 50. Spring 50 can be slidably disposed around second stem 40.

Figure 7:
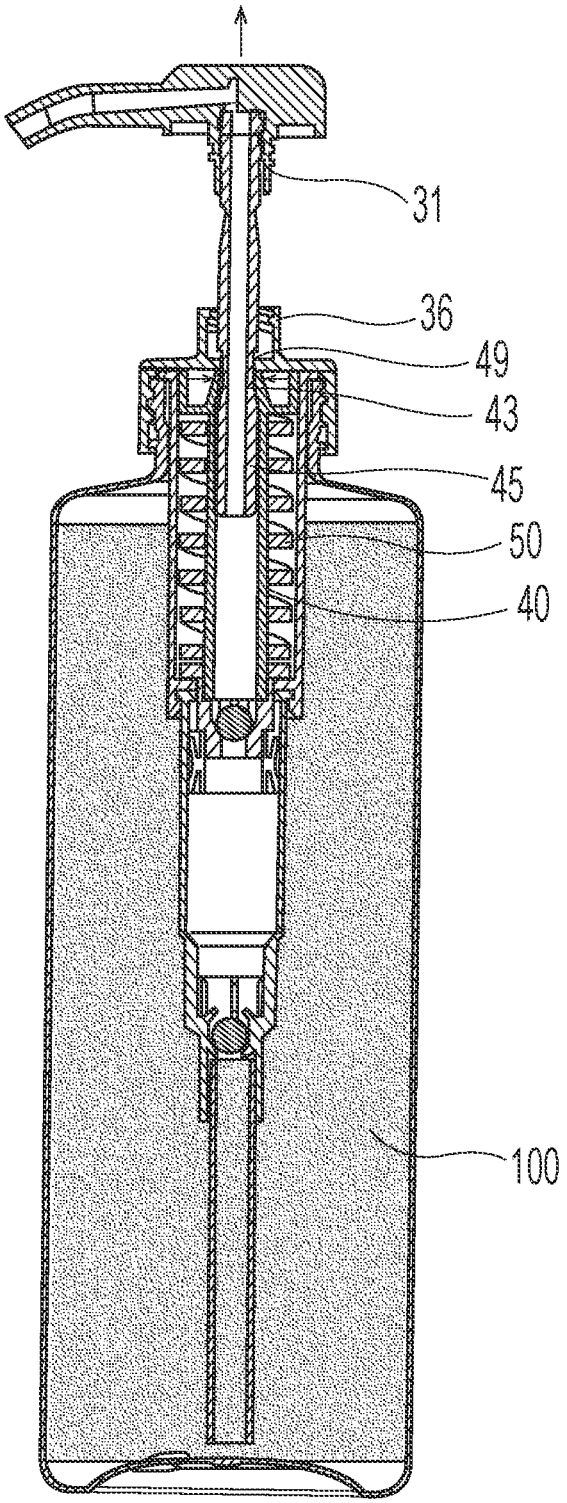
FIG. 7 is a cross-sectional view of the pump dispenser of FIG. 3 in the dispense ready position before priming.

First housing 55 can be disposed around spring 50 in both the locked storage configuration (FIG. 5) and the pump ready configuration (FIG. 7). First housing 55 prevents the spring from being in contact with liquid product 100, which can prevent the spring from weakening due to interacting with liquid product 100 during storage and use. First housing 55 can include a platform 59 to contrast the compression of spring 50. First housing can include lip 56 that is pressed between the closure 35 and neck landing zone 24. In some examples, the bottom surface of lip surface can include a PP or PE gasket to form a robust seal with the neck landing zone.

A hollow sub-stem 70 can be rigidly joined to second stem 40 at or near the end distal to platform 41. The hollow sub-stem 70 can be in fluid communication with channel 42. Sub-stem 70 can be configured to contain the first ball 60, which can be a one-way valve, specifically a one-way ball valve. The ball valve can open and close in response to a change in pressure in dosing chamber 91. Sub-stem 70 can be in fluid communicating with dosing chamber 91 of second housing 90. An outer surface of sub-stem 70 can be rigidly connected to piston 75. Piston 75 can both form a seal and slidably engage the inner wall of second housing 90.

As shown in the embodiment in FIG. 5, second housing 90 can interlock with first housing 55 that can form a rigid, snap-fit connection. In an alternative configuration, the first and second housing can be one piece, for example one injection molded part. Second housing 90 can have dosing chamber 91. In the locked storage configuration dosing chamber 91 does not contain liquid product. Inner volume 91 can be configured to present a platform or narrowed region, which can limit the downward vertical motion of piston 75. Second housing 90 also contains valve seat 94 configured to host second ball 80, which can form a one-way valve, in particular a one-way ball valve. The base of the second housing, which is at the opposite end of the top end that engages with the first housing, has an opening configured to receive dip tube 95. Dip tube 95 is in fluid communication with the dosing chamber of the second housing. The dip tube can be either extrusion-cut or injected.

Dip tub 95 is configured to transfer liquid product 100 from bottle 2 passed the one-way valve formed by second ball 80 and valve seat 94, through channel 42 and piston 75, passed first ball valve and into first stem cavity 47 through cavity 30 and out spout 32 into a user's hand or cleaning implement.

In the locked storage configuration, which is prior to first actuation and use, shown in FIG. 5, spring 50 is stored in the first housing 55 and is substantially uncompressed without any preload. The lack of preload during storage and shipment can minimize the spring elastic modulus to contrast creep thus minimizing the force to actuate during use while still achieving a good spring-back/recovery after actuation. This arrangement can also allow using a spring with relatively high length and stroke for high dosages, thus further minimizing the force to actuate. The height of the pump dispenser is minimized by storing at least a portion of the spring in the neck in the locked storage configuration. The pump head threads 34 of pump head 31 are engaged with mating closure threads 36 of closure 35, thus preventing any accidental actuation. Additionally, dosing chamber 91, channel 42, first stem cavity 47, and cavity 30 in pump head 31 all contain substantially no liquid product in the locked storage configuration.

Figure 6:
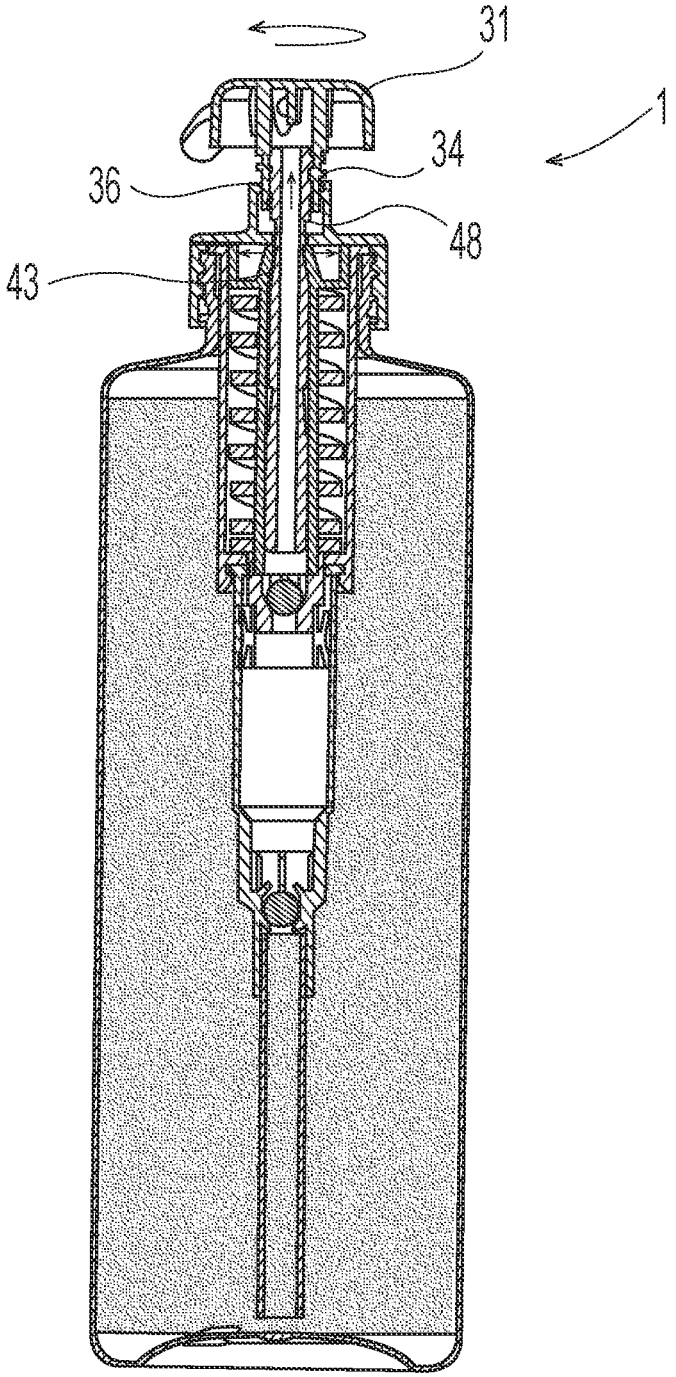
FIG. 6 is a cross-sectional view of the pump dispenser of FIG. 2 during pump head unlocking before the first use.

FIG. 6 is a cross-sectional view of the pump dispenser of FIG. 2 during pump head unlocking. Upon first use, the user can rotate pump head 31 and pump head threads 34 can disengage from closure threads 36 and cantilever 43 of the second stem disengage from the first snaps 48 of the first stem. To a user, this appears to be how they would typically open pump dispensers that are commonly used for soap, shampoo, conditioner, lotion, etc. and therefore no new habits need to be taught and/or adopted.

FIG. 7 is a cross-sectional view of the pump dispenser of FIG. 3 in the dispense ready position before it has been primed. Once the threads 34 are completely disengaged from the mating closure threads 36, the use can pull the pump head upwards. This can cause the cantilevers 43 of the second stem to engage, for example by snap fit or otherwise interconnectedness, with the second snaps 49 of the first stem. In this configuration, the first stem 45 and second stem 40 are rigidly connected. As shown in FIG. 7, when spring 50 is in the dispense ready position it can be substantially uncompressed. However, in other embodiments, as discussed hereafter, the spring can have a slight compression when it is in the dispense ready position.

Figure 8:
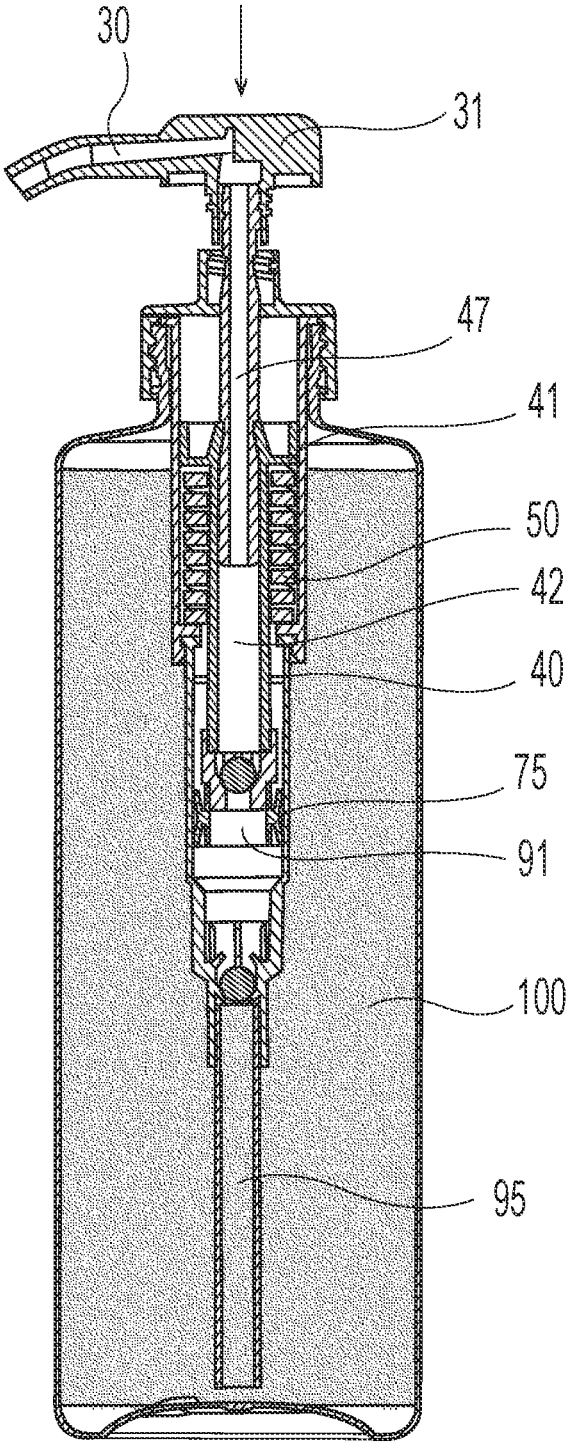
FIG. 8 is a cross-sectional view of the pump dispenser of FIG. 3 during actuation.

FIG. 8 is a cross-sectional view of the pump dispenser of FIG. 3 during actuation. While pressing on the pump head 31, the piston 75 is pushed downwards thus reducing the volume of the chamber 91. The second stem 40 compresses the spring 50 via the platform 41. Upon releasing the pressure on the pump head, a vacuum is creating pulling product from the bottle via the dip tube. After a few actuations (typically between 1 to 10 depending on the volume of the conduits and the pump dosage), dip tube 95, pump inner chamber 91, channel 42, first stem cavity 47, and cavity 30 will fill with liquid product 100 and the pump assembly is 'primed.'

Figure 9:
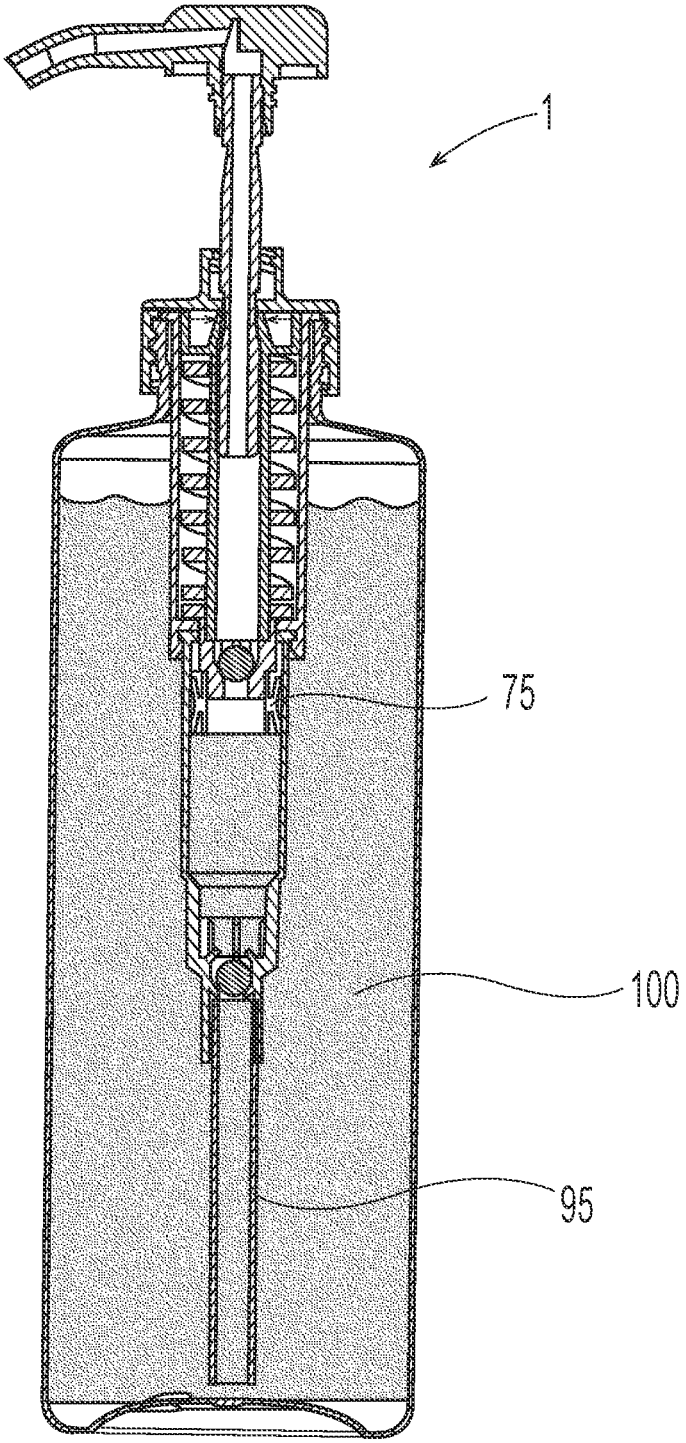
FIG. 9 is a cross-sectional view of the pump dispenser of FIG. 3, in the dispense ready position after priming.

FIG. 9 is a cross-sectional view of the pump dispenser of FIG. 3, in the dispense ready position after it has been primed. Liquid product 100 is present in areas below the piston 75, including dip tub 95.

Figure 10:
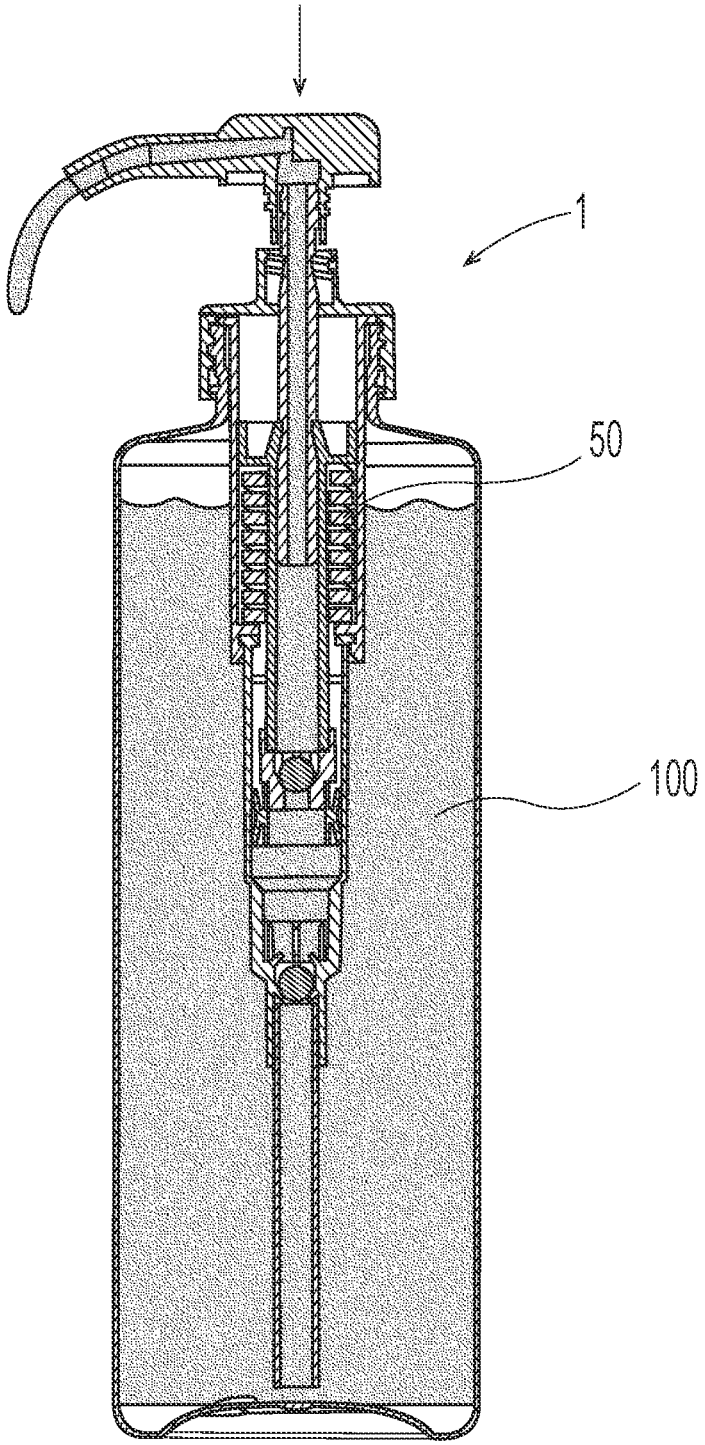
FIG. 10 is a cross-sectional view of the pump dispenser of FIG. 3 during dispensing.

FIG. 10 is a cross-sectional view of the pump dispenser of FIG. 3 during dispensing of the primed pump. As shown in FIG. 10, the spring 50 is not contacting liquid product 100 during dispensing. Liquid product 100 is not in contact with the spring in the locked storage ready position (see FIGS. 2 & 4) the dispense ready position, pre-priming (see FIG. 7), during priming (see FIG. 8), the dispense ready position, post-priming (see FIG. 9), and the dispensing position (see FIG. 10).

Figure 11:
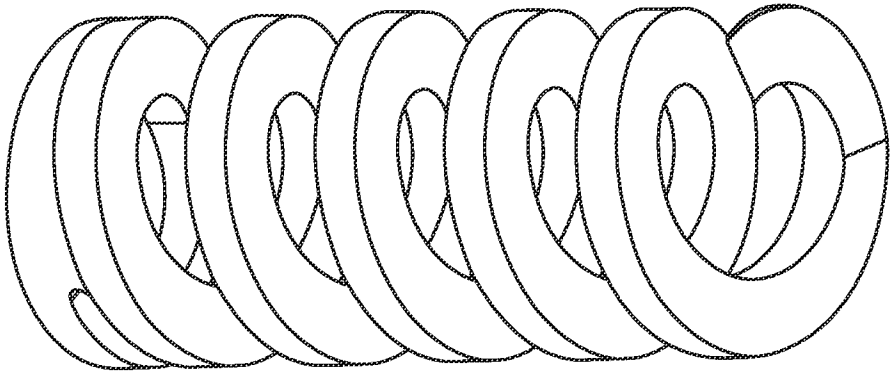
FIG. 11 is a perspective view of a plastic spring with a single helix design with 5 coils.
Figure 12:
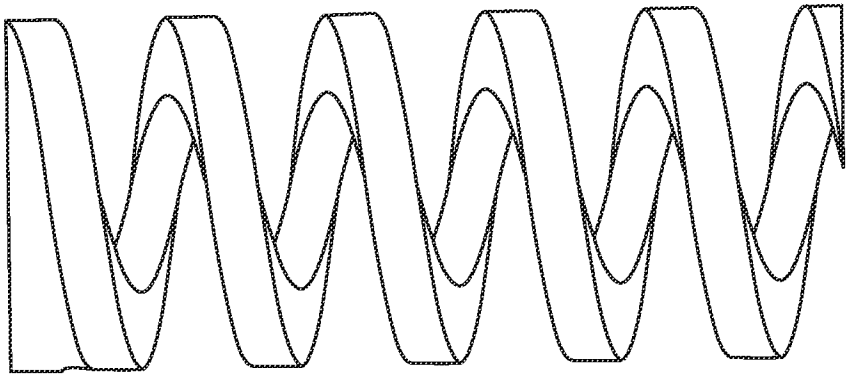
FIG. 12 is a side view of the plastic spring of FIG. 11.

FIGS. 11 and 12 is a perspective and a side view, respectively, of a single helix plastic spring with 5 coils (commercially available as FT200WV homopolymer pp from Braskem®) that can be used as the spring in the pump assembly described herein Immediately after priming, this spring was found to have an average peak force of 20 N at 90% of the full stroke as determined by the Spring Specifications and Average Peak Force to Actuate Test Method, described hereafter. During use, the spring was found to reduce its length by approximately 1 mm due to permanent deformation.

Figure 13:
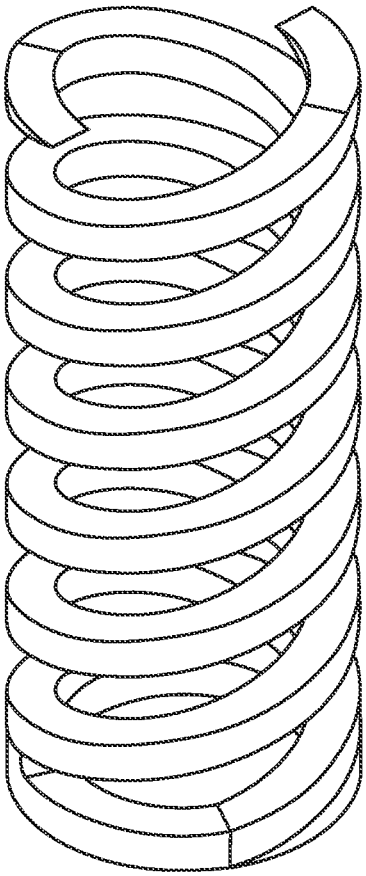
FIG. 13 is a perspective view a plastic spring with a double helix design.
Figure 14:
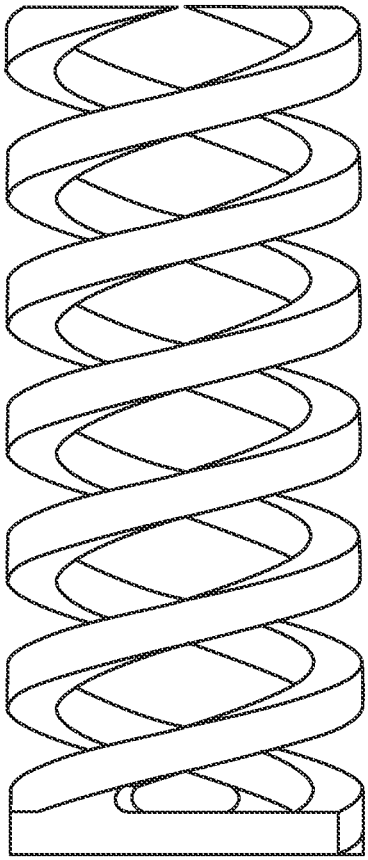
FIG. 14 is a side view of the spring of FIG. 13.

FIGS. 13 and 14 is a perspective and a side view, respectively, of an example of a double helix plastic spring that can be used as the spring in the pump assembly described herein.

Figure 15:
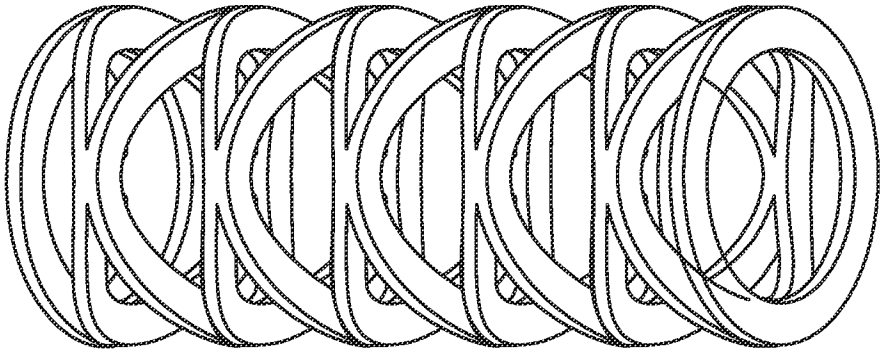
FIG. 15 is a perspective view of a plastic spring with a wave plastic design.
Figure 16:
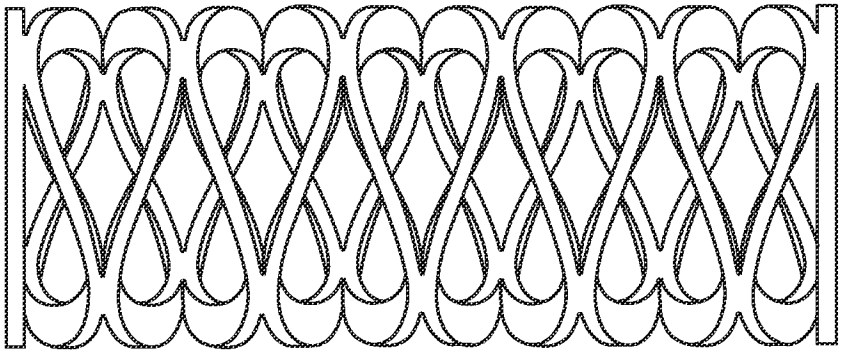
FIG. 16 is a side view of the spring of FIG. 15.

FIGS. 15 and 16 is a perspective and a side view, respectively, of an example of a wave plastic spring design that can be used as the spring in the pump assembly described herein.

Figure 17:
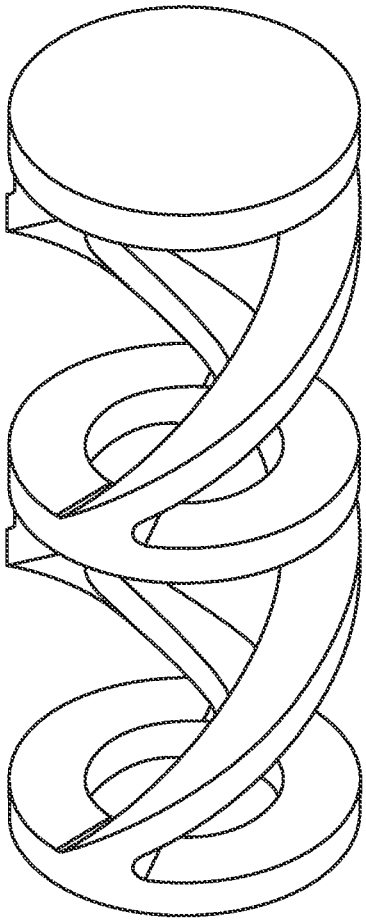
FIG. 17 is a perspective view of a plastic spring with a double stack double helix design.
Figure 18:
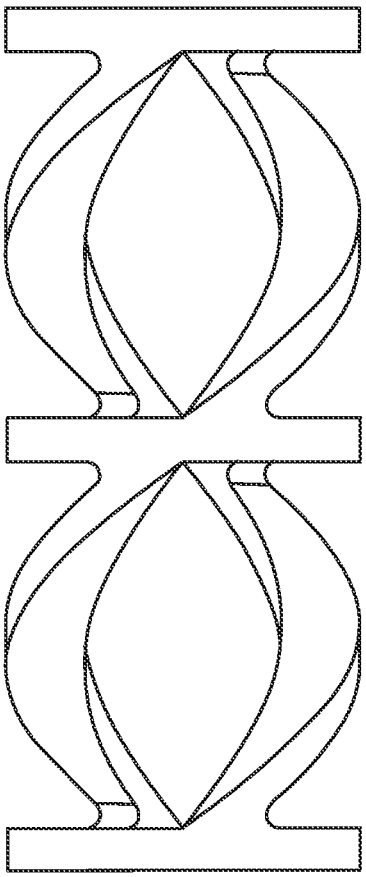
FIG. 18 is a side view of the spring of FIG. 17.

FIGS. 17 and 18 is a perspective and a side view, respectively, of an example of a double stack double helix spring design that can be used as the spring in the pump assembly described herein.

By running simulations, it was found that selecting a double helix plastic springs (as exemplified in FIGS. 13 and 14), a wave plastic spring design (as exemplified in FIGS. 15 and 16), and a double stack double helix spring design (as exemplified in FIGS. 17 and 18) can be advantageous to increase the spring constant while reducing the spring length as compared to a single helix plastic spring (as exemplified in FIGS. 11-12). However, it was found that these springs resulted in high permanent deformation once actuated, thus resulting into higher dosage variability.

Figure 19:
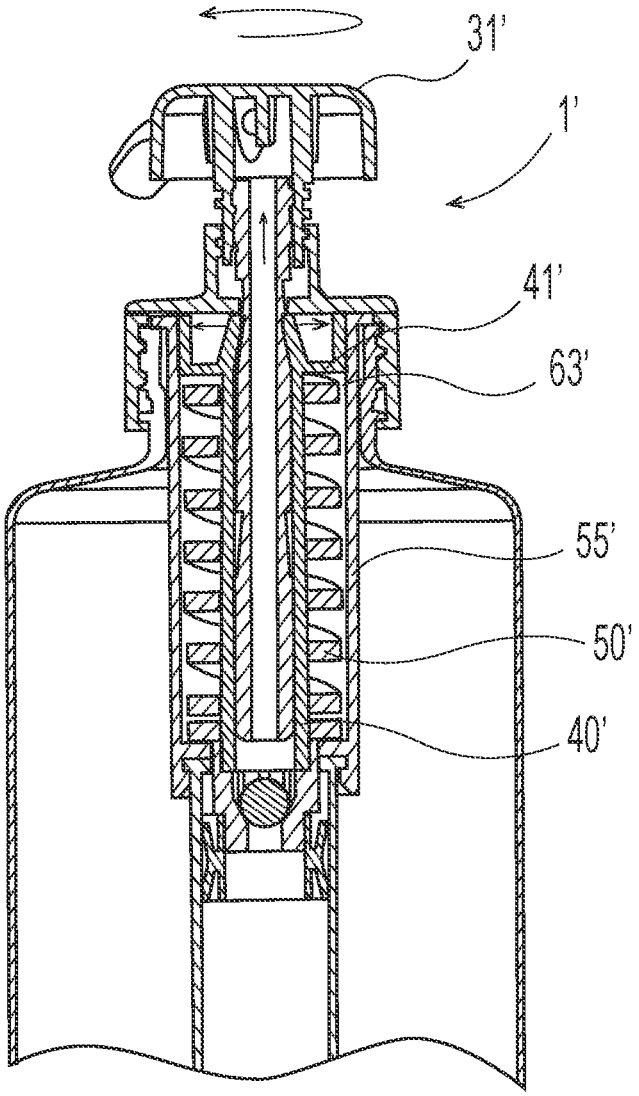
FIG. 19 is a cross-sectional view of a pump dispenser during pump head unlocking before the first use.

FIG. 19 shows a cross-sectional view of a pump dispenser 1' during pump head unlocking upon first use. In this embodiment, the inner wall of the first housing 55' having retention feature 63'. Retention feature 63' does not engage spring 50 during in the locked shipment configuration or when the pump head 31' is unlocked. In the locked storage configuration and when the pump head is unlocked, platform 41' of the second stem 40' is spaced from spring 50'.

Figure 20:
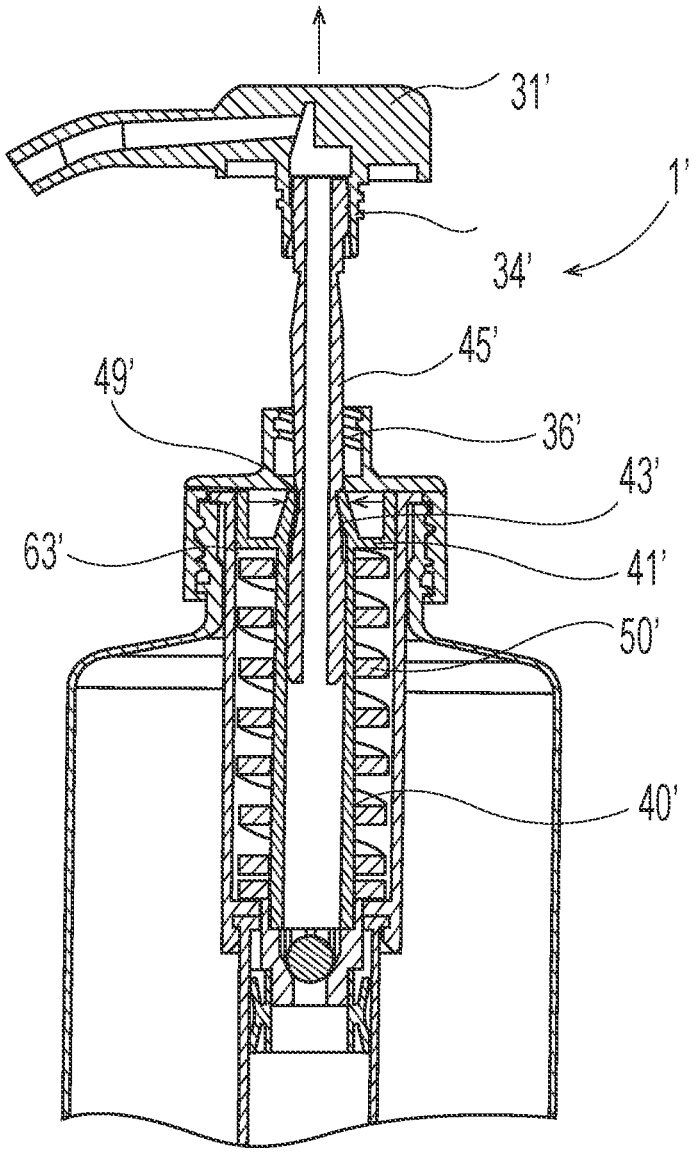
FIG. 20 shows a cross-sectional view of a pump dispenser in the dispense ready configuration.

FIG. 20 shows a cross-sectional view of a pump dispenser 1' in the dispense ready configuration. Once the pump head threads 34' are completely disengaged from the closure threads 36', the user can pull the pump head 31' upwards causing the cantilevers 43' of the second stem to interlock or otherwise engage with the first stem 45' at second snap fit 49'. In this configuration, the first stem 45' and second stem 40' can be rigidly connected. In this configuration, the retention feature 63' still does not engage the spring 50' and platform 41' is spaced from spring 50'.

Figure 21:
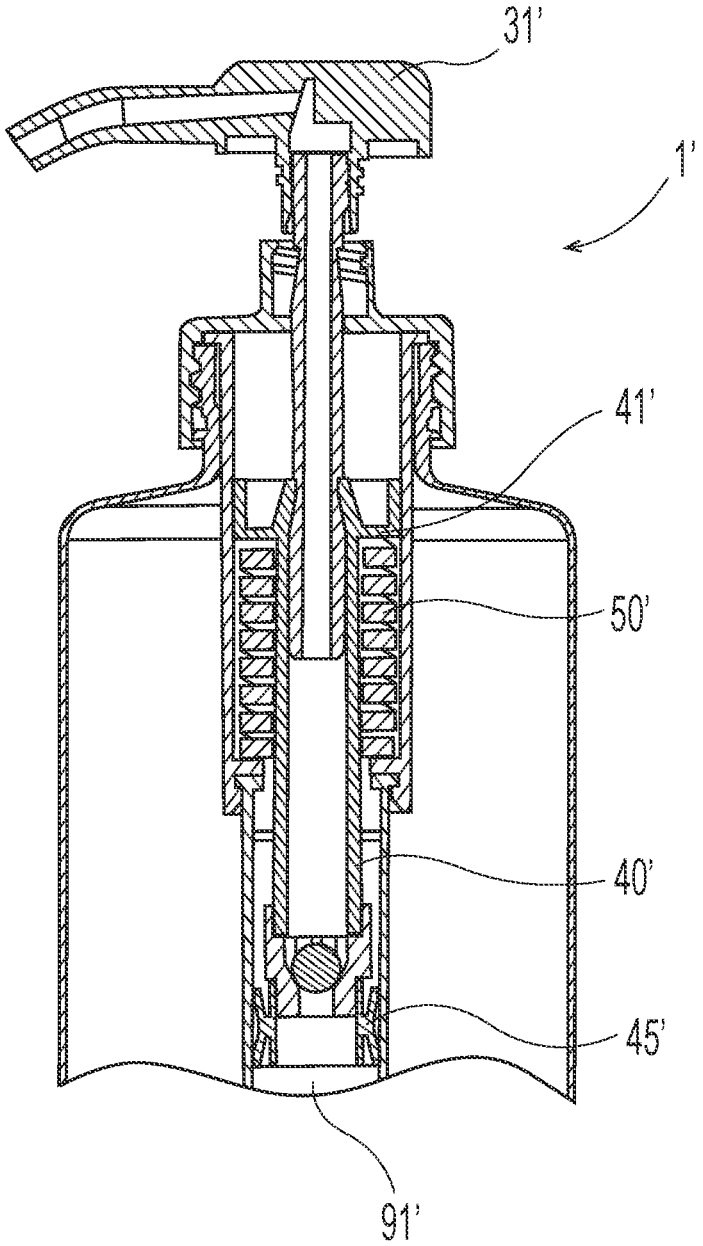
FIG. 21 shows a cross-sectional view of a pump dispenser during the pump head actuation.

FIG. 21 shows a cross-sectional view of pump dispenser 1' during the pump head actuation. While pressing on the pump head 31', the piston 45' is pushed downwards thus reducing the volume of the dosing chamber 91'. Second stem 40' compresses spring 50' via platform 41'.

Figure 22:
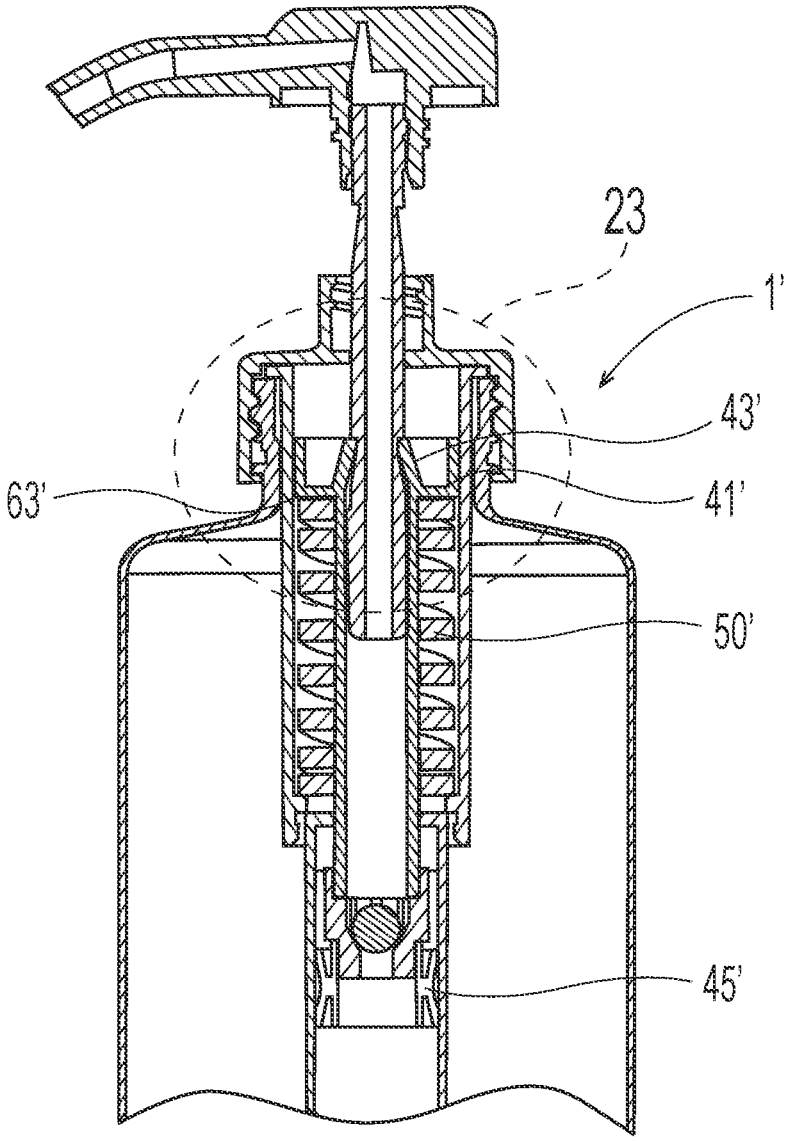
FIG. 22 shows a cross-sectional view of a pump dispenser after pump head actuation.

FIG. 22 shows a cross-sectional view of pump dispenser 1' after pump head actuation. While releasing the pressure on the pump head, the piston 45' returns upon the pressure exerted by the spring on 50' the platform 41'. However, the spring expansion is contrasted by contact between the cantilever 43' of second stem 40' and the retention feature 63'. This exerts a pre-load on the spring 50' to help produce a consistent stroke between actuation over the life of the pump dispenser. In this configuration, the retention feature 63' engages the spring 50' and platform 41' is adjacent to and not spaced from spring 50'.

Figure 23:
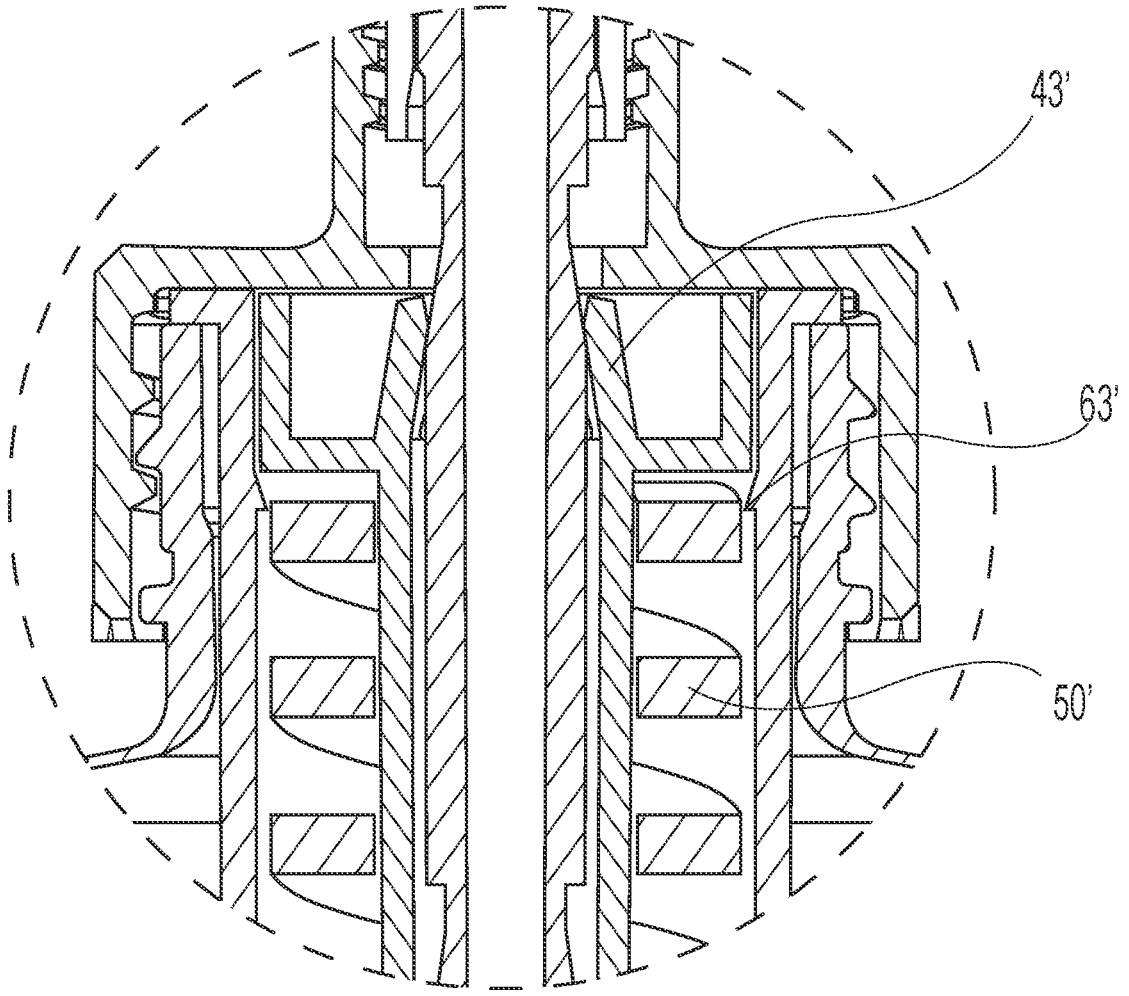
FIG. 23 is an enlarged view of a portion of FIG. 22.

FIG. 23 is an enlarged view of a portion of FIG. 22. FIG. 23 shows retention feature 63' interlocking or otherwise engaging with cantilever 43' to place the spring 50' in compression after the first pump.

Figure 24C:
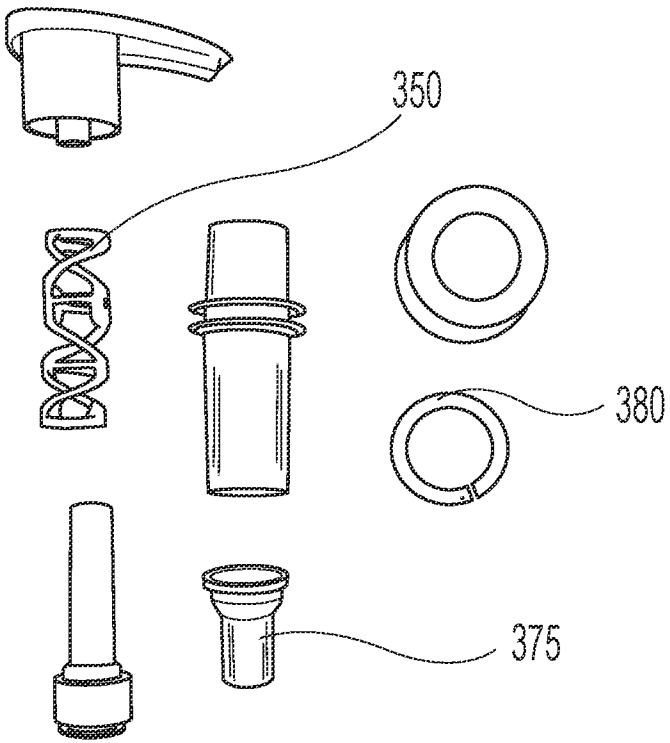
FIG. 24C shows the components of the pump assembly of FIG. 24B.
Figure 24B:
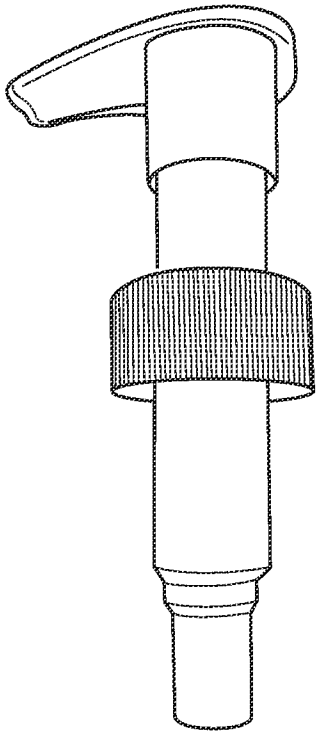
FIG. 24B shows a portion of the pump assembly of Pump Dispenser C.
Figure 24A:
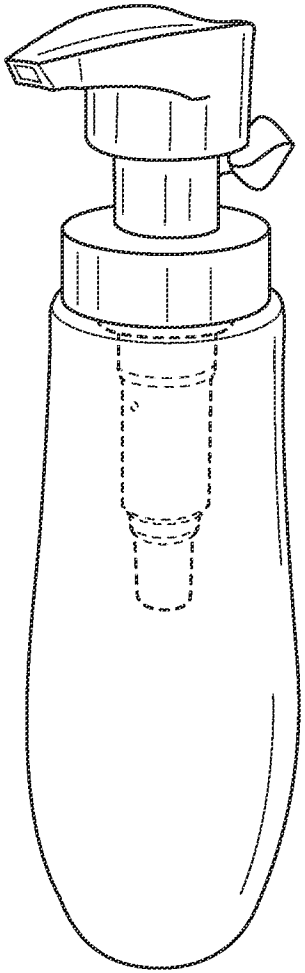
FIG. 24A shows Pump Dispenser C.

Table 1 to Table 6, hereafter, describe various attributes for the following six pump dispensers:

- Pump Dispenser A: Control (LC Metal): model L509-316-0.85 mm available by ZHONGSHAN LUENCHOENG DISPENSING PUMP LTD. (CLC)
- Pump Dispenser B: Inventive Example
- Pump Dispenser C: Is a drawing of the ZHONGSHAN LUENCHOENG DISPENSING PUMP LTD. (CLC) plastic pump dispenser E50AAA-33/410A is shown in FIG. 24A. FIG. 24B is a drawing of the assembled pump assembly without a dip tube. FIG. 24C is a drawing of the components of the pump assembly of FIG. 24B.
- Pump Dispenser D: Is commercially available as MONO PUMP from Taplast® and shown in FIG. 25. Components of Pump Dispenser D are described in US Pub. No. 2017/0326567, hereby incorporated by reference.
- Pump Dispenser E: Is commercially available as LIFE CYCLE PUMP from Silgan® and shown in FIG. 26. Components of Pump Dispenser E are described in U.S. Pat. No. 10,138,971, hereby incorporated by reference.

Pump Dispenser F: Is commercially available as ECO GREEN from Hana® and shown in FIG. 27.

Table 1, below, compares the locked pump height, the spring material, and the recyclability of the Pump Dispensers A-F. The locked pump height is measured from the neck landing zone to the top of the pump head when the pump dispenser is in the locked storage position. The neck landing zone is the highest part of the bottle neck measured from the base (see reference numeral 24 in FIGS. 4-5). The locked pump height can be used on current store shelves with minimal cost impact if it is less than 25 mm

TABLE 1

| Pump Dispenser | Locked Pump Assembly Height (mm) | Spring Material | Is the pump dispenser recyclable in current recycling streams? |
|---|---|---|---|
| Pump Dispenser A: Control (LF Metal) | 23 | 316SS (stainless steel) | No |
| Pump Dispenser B: Inventive Example | 23 | PP | Yes |
| Pump Dispenser C: LC Plastic | 40 | Polybutylene terephthalate (PBT) | No, if the bottle is PET |
| Pump Dispenser D: Taplast ® | 20 | Thermoplastic Olefin-PP | Yes |
| Pump Dispenser E: Silgan ® | 28 | PP | Yes |
| Pump Dispenser F: Hana ® | 28 | PP | Yes |

The pump assembly of Dispenser A has a metal spring, which is generally considered a contaminant in current recycling streams.

The pump assembly of Pump Dispenser B is recyclable in current PE, PP and PET recycling streams and has a locked pump height of 23 mm, which will fit in current store shelves.

The pump assembly of Dispenser C, shown in FIGS. 2A-C is 90%, by weight of the pump assembly, PP including the dip tube. FIG. 24C shows the components of Pump Dispenser C including gasket 380 and piston 375, which comprise 5%, by weight of the pump dispenser, are made from PE, and spring 350, which comprises 5%, by weight of the pump dispenser, and is made from polybutylene terephthalate (PBT). Since PBT is considered a contaminant in the PET stream, the Pump Dispenser C can be considered recyclable without disconnecting the pump assembly and the bottle only if the bottle is made of PP (preferably) or HDPE (less so, at mixture of HDPE and PP will cause the package to be likely downcycled above certain thresholds with some yield losses). However, PP bottles have weak drop resistance at low temperature that can be encountered during shipping or storage. PP bottles are generally not consumer preferred for many products, in particular beauty care products, where consumers often want a clear bottle, that feels sturdy and glossy, which can convey quality. PP bottles are cloudy and can feel flimsy and dull, which can be less desirable. Pump Dispenser C has a locked pump height of 40 mm, which can be too tall to fit on current store shelves without redesigning the bottle or modifying the height of the shelves.

Figure 25:
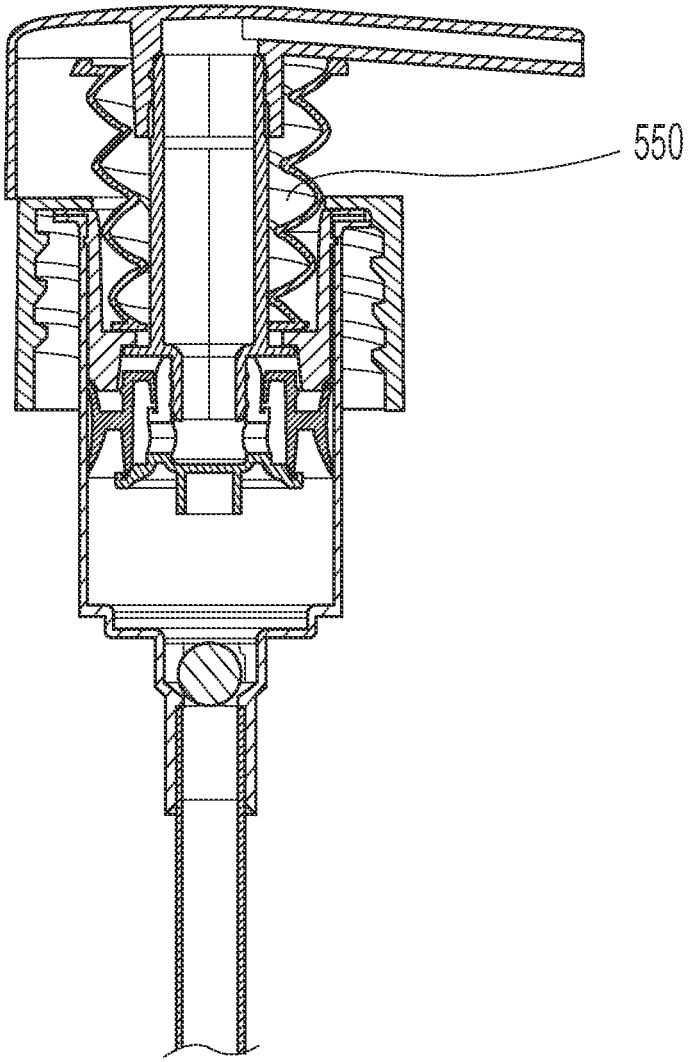
FIG. 25 is a portion of the pump assembly of Pump Dispenser D.

The pump assembly of Pump Dispenser D, shown in FIG. 25, is 98% PP, by weight of the pump assembly, and can therefore be recycled in current recycling streams. The spring in this pump is bellows 550 made of a thermoplastic polyolefin (TPO)/PP blend, which is typically compatible with the PP recycling stream. The bottle can be made in PP or PET, to minimize HDPE contamination with PP. The pump can be recycled with HDPE bottles for some downcycling applications with reduced yield. The locked pump height is 20 mm, which will fit on current store shelves.

Figure 26:
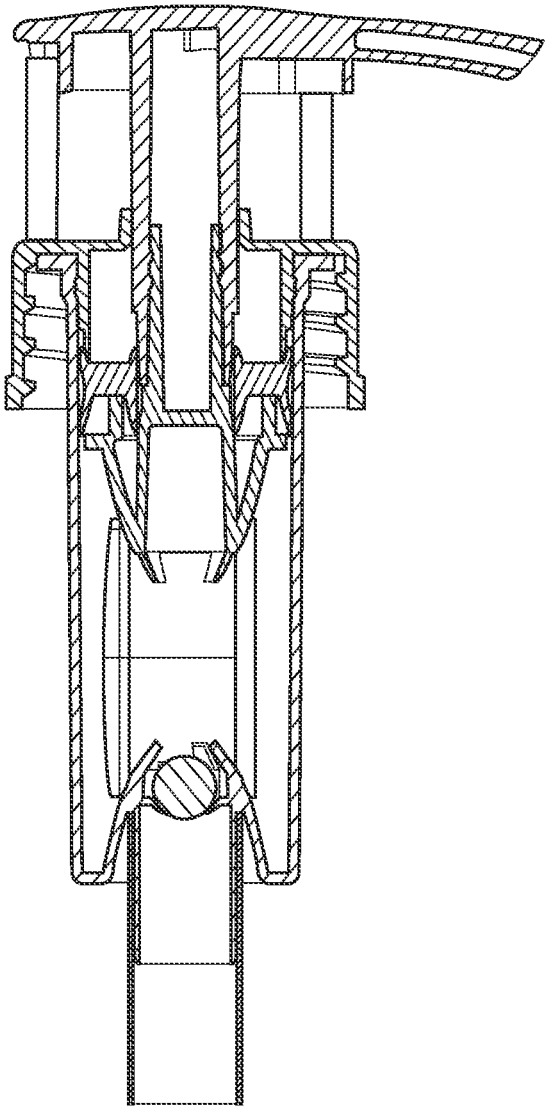
FIG. 26 is a portion of the pump assembly of Pump Dispenser E.

The pump assembly of Pump Dispenser E, shown in FIG. 26, is predominantly made of HDPE (~90%) and is capable of being recycled in current recycling channels with both HDPE and PET bottles. The locked pump height is slightly larger than 25 mm and may not be desirable, since the pump dispenser is too tall to fit on current store shelves without redesigning the bottle or modifying the height of the shelves.

Figure 27:
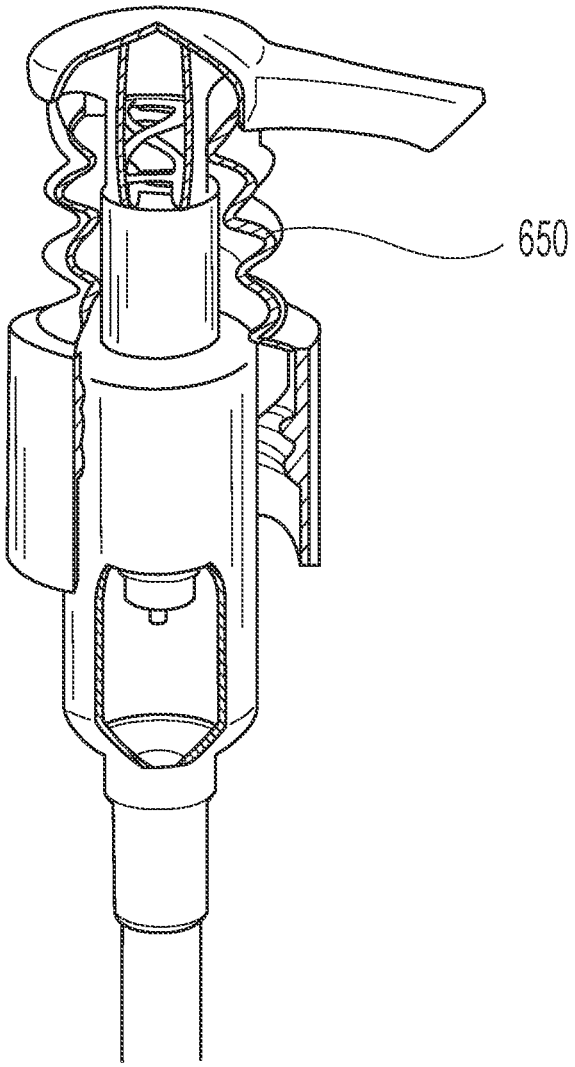
FIG. 27 shows a portion of the pump assembly of Pump Dispenser F.

The pump assembly of Pump Dispenser F, shown in FIG. 27, is 100%, by weight of the pump dispenser, made of PP-based grade materials and can therefore be recycled in current recycling streams. The bottle could be made in PP or PET to minimize HDPE contamination with PP. Alternatively, the pump can be recycled if the bottle is HDPE in downcycling applications. The locked pump height is slightly larger than 25 mm and may not be desirable, since standard bottles may have to be redesigned to fit on current store shelfs.

Table 2, below, compares the spring length at different points in the life cycle of the pump dispenser for the different pump assemblies. The spring can provide enough recovery force after actuation to provide an acceptable recovery speed (preferably below 0.5 seconds after actuation) throughout the life of the pump. However, if the spring is too stiff it can be difficult for the consumer to dispense the intended amount of product in a stroke with an acceptable force to actuate.

The spring lengths were measured under the following conditions: (1) undeformed in free natural rest state (F), (2) deformed by the same pre-load exerted during the pump storage (un-actuated) assembly condition (P), (3) deformed at the test deflection (TD) when the pump is subjected to 90% of the intended full actuation stroke (defined as test stroke i.e. TS). The spring lengths at rest and pump storage positions were measured using a caliper, for some examples an opening was made in the shroud to view the spring, if it was not visible. The spring length for any loaded condition was measured tracking the deflection of the force meter. The spring force at 90% stroke was measured using the Spring Specifications and Average Peak Force to Actuate Test Method, described hereafter.

TABLE 2

| | Spring Formation | | | | | | |
|---|---|---|---|---|---|---|---|
| Pump | Spring length undeformed (mm) F | Spring length preloaded (mm) P | Spring Preload (mm) PL = F − P | Full stroke (mm) FS | Test stroke (mm) TS = 0.9 S | Test deflection (mm) TD = TS + PL | Spring Force (N) at 90% stroke |
| Pump Dispenser A: Control (CLC | 58.5 | 47 | 11.5 | 22 | 20 | 31.5 | 20 ± 1.0 |

TABLE 2-continued

| Spring Formation | | | | | | | |
|---|---|---|---|---|---|---|---|
| Pump | Spring length undeformed (mm) F | Spring length preloaded (mm) P | Spring Preload (mm) PL = F − P | Full stroke (mm) FS | Test stroke (mm) TS = 0.9 S | Test deflection (mm) TD = TS + PL | Spring Force (N) at 90% stroke |
| Metal) | | | | | | | |
| Pump Dispenser B: Inventive Example | 55 | 55 | 0 | 22 | 20 | 20 | 20 ± 1.0 |
| Pump Dispenser C: CLC Plastic | 58 | 54 | 4 | 15.5 | 14 | 18 | 30 ± 1.0 |
| Pump Dispenser D: Taplast ® | 31 | 29 | 3 | 13.5 | 12 | 15 | 17 ± 1.0 |
| Pump Dispenser E: Silgan ® | 28 | 27 | 1 | 13.5 | 12 | 13 | 28 ± 2.0 |
| Pump Dispenser F: Hana ® | 60 | 50 | 10 | 18 | 16 | 26 | 28 ± 1.0 |

The configuration of the pump assembly of Pump Dispenser A included a linear spring with a single arm helical design that required a large compression of the spring in the locked storage position, as indicated by the 11.5 mm compression in spring preload in Table 2. This design approach is challenging when shifting to a plastic spring as the spring may need to be over-designed to compensate for the loss of modulus caused by the spring creep during storage. This can result in compromises that are not consumer acceptable, such an excessive force to actuate or low dosage per stroke.

The configuration of the pump assembly of Pump Dispenser B included a spring with a single helix arm design and had no spring preload, as indicated by the 0 mm compression in spring preload in Table 2, which limited the stress on the spring during storage. In Pump Dispenser B, spring pre-load occurred after the first actuation, but not during shipping and storage.

The configuration of the pump assembly of Pump Dispensers C, D, and E all had a relatively small amount of preload, as indicated by the 1-4 mm of compression in spring preload in Table 2. The spring used in Dispenser C was linear S-type. The spring used in Dispenser D was a bellows, which was non-linear. The spring used in Dispenser E was a C-spring i.e. including a slotted tubular elastic element compressed between two loading supports. It was found that since the product is stored for an extended amount of time prior to use, even a small amount of compression stressed the spring to a strain level requiring compensation.

The configuration of the assembly of Pump Dispenser F included a linear helical plastic polypropylene spring and had a relatively large compression in the locked storage position, as indicated by the 10 mm compression in spring preload in Table 2. This configuration is expected to stress a plastic spring during storage causing irreversible deformation.

Table 3, below, shows the average peak force and outlet per stroke of Pump Dispensers A-F when dispensing water. The force to actuate at 90% stroke and return time was measured using the Pump Average Peak Force to Actuate and Return Time Test Method, described hereafter, with a test speed of 200 mm/min. The average output per stroke was determined by the Average Output per Stroke Test Method, described hereafter. The water was in contact with the spring in Pump Dispensers A, E, and F.

TABLE 3

| Test with Water | | | |
|---|---|---|---|
| | Avg. Peak Force (N) at 90% stroke-Water | Avg. Output per Stroke (ml)-Water | Returning Time |
| | Success Criteria | | |
| Pump | <45N | 4.0 +/− 0.4 ml | <0.5 s |
| Pump Dispenser A: Control (CLC Metal) | 21 ± 1.0 | 4.3 ± 0.1 | OK |
| Pump Dispenser B: Inventive Example | 21 ± 1.0 | 3.9 ± 0.2 | OK |
| Pump Dispenser C: CLC Plastic | 31 ± 1.0 | 3.8 ± 0.2 | OK |
| Pump Dispenser D: Taplast ® | 55 ± 6.0 | 3.9 ± 0.2 | OK |
| Pump Dispenser E: Silgan ® | 30 ± 1.0 | 4.4 ± 0.2 | OK |
| Pump Dispenser F: Hana ® | 28 ± 1.0 | 3.2 ± 0.1 | OK |

As shown in Table 3, The average peak force was found generally aligned to the force measured in the spring compression experiments with exception of the Pump Dispenser D. All pumps were found to deliver an output per stroke of 4.0+/−0.4 ml with exception of the Pump Dispenser F. The return time was found below 0.5 seconds for all pump dispensers.

Table 4, below, shows the average peak force and outlet per stroke of Pump Dispensers A-F when dispensing a shampoo (Head & Shoulders® Classic Clean Shampoo, commercially available in China in 2020). The spring force at 90% stroke and return time was measured using the Pump Average Peak Force to Actuate and Return Time Test Method, described hereafter, with a test speed of 200 mm/min. The average output per stroke was determined by the Average Output per Stroke Test Method, described hereafter. The shampoo was in contact with the spring in Pump Dispensers A, E, and F.

TABLE 4

| Test with Shampoo | | | |
|---|---|---|---|
| | Avg. Peak Force (N) at 90% stroke | Avg. Output per Stroke (ml) Success Criteria | Returning Time |
| Pump | <45N | 4.0 +/− 0.4 ml | <0.5 s |
| Pump Dispenser A: Control (CLC Metal) | 28 ± 1.0 | 4.2 ± 0.1 | OK |
| Pump Dispenser B: Inventive Example | 29 ± 2.0 | 3.8 ± 0.2 | OK |
| Pump Dispenser C: CLC Plastic | 40.0 ± 2.0 | 3.5 ± 0.1 | OK |
| Pump Dispenser D: Taplast ® | 66.0 ± 7.0 | 2.8 ± 0.3 | OK |
| Pump Dispenser E: Silgan ® | 41 ± 3.0 | 2.6 ± 0.3 | OK |
| Pump Dispenser F: Hana ® | 38 ± 1.0 | 2.3 ± 0.2 | OK |

As shown in Table 4, Pump Dispenser B met the average force to actuate and dosage success criteria and delivered a dispensing performance similar to Pump Dispenser A, a pump assembly with a metal spring. Pump Dispenser D showed high force to actuate compared to the other examples. The output per stroke delivered by Pump Dispenser C-F was lower than what tested with water (see Table 3) and overall suboptimal for this application.

Table 5, below, tests the average peak force and outlet per stroke of Pump Dispensers A-F when dispensing conditioner (Pantene® Smooth & Sleek Conditioner, commercially available in United States in 2020). The spring force at 90% stroke and return time was measured using the Pump Average Peak Force to Actuate and Return Time Test Method, described hereafter, with a test speed of 200 mm/min. The average output per stroke was determined by the Average Output per Stroke Test Method, described hereafter. The conditioner was in contact with the spring in Pump Dispensers A, E, and F.

TABLE 5

| Test with Conditioner | | | |
|---|---|---|---|
| | Avg. Peak Force (N) at 90% stroke | Avg. Output per stroke (ml) Success Criteria | Returning Time |
| Pump | <45N | 4.0 +/− 0.4 ml | <0.5 s |
| Pump Dispenser A: Control (CLC Metal) | 29 ± 1.0 | 4.0 ± 0.1 | OK |
| Pump Dispenser B: Inventive Example | 30 ± 2.0 | 3.8 ± 0.2 | OK |
| Pump Dispenser C: CLC Plastic | 35.0 ± 3.0 | 3.5 ± 0.2 | OK |
| Pump Dispenser D: Taplast ® | 75.0 ± 15.0 | 3.1 ± 0.3 | OK |
| Pump Dispenser E: Silgan ® | 33.0 ± 3.0 | 3.2 ± 0.5 | OK |
| Pump Dispenser F: Hana ® | 33.0 ± 2.0 | 2.5 ± 0.4 | OK |

As shown in Table 5, Pump Dispenser B met the average force to actuate and dosage success criteria and delivered a dispensing performance similar to Pump Dispenser A, a pump assembly with a metal spring. Similar to both shampoo (see Table 4) and water examples (see Table 3), the Pump Dispenser D had a high force to actuate compared to the other examples. The output per stroke delivered by Pump Dispensers C to F was found lower than what tested with water and overall suboptimal for this application.

Table 6, below, summarizes that data in Table 1 to Table 5 and shows that Pump Dispenser B is the only dispenser tested that meets all of the criteria.

TABLE 6

| Summary Table | | | | | | |
|---|---|---|---|---|---|---|
| | Pump Dispenser A: Control (LF Metal) | Pump Dispenser B: Inventive Example | Pump Dispenser C: LC Plastic | Pump Dispenser D: Taplast ® | Pump Dispenser E: Silgan ® | Pump Dispenser F: Taplast ® |
| Is pump dispenser recyclable in current recycling streams? | No | Yes | No | Yes | Yes | Yes |
| Is the pump height <25 mm in the storage configuration? | Yes | Yes | No | Yes | No | No |
| Is there no preload on the spring in the storage configuration? | No | Yes | No | No | No | No |
| Is the spring protected from the product in the storage configuration? | No | Yes | Yes | Yes | No | No |
| Is the avg. peak force (N) at 90% stroke <45N with shampoo and conditioner? | Yes | Yes | No | No | Yes | Yes |
| Is the output per stroke (mL) | Yes | Yes | Yes | Yes | Yes | No |

TABLE 6-continued

| Summary Table | | | | | | |
|---|---|---|---|---|---|---|
| | Pump Dispenser A: Control (LF Metal) | Pump Dispenser B: Inventive Example | Pump Dispenser C: LC Plastic | Pump Dispenser D: Taplast ® | Pump Dispenser E: Silgan ® | Pump Dispenser F: Taplast ® |
| 4.0 +/− 0.4 ml for shampoo and conditioner? | | | | | | |

Test Methods

Average Output Per Stroke (OPS)

This test method covers the measurement of the mean quantity-by-weight of liquids dispensed from a mechanical dispenser on each actuation. The test method is identical in procedure to ASTM D4336-18 (Gravimetric Method #1); regarding precision, reproducibility and sensitivity please refer to the standard.

Equipment: balance with direct reading to 0.01 g and able to tare the package; samples to be tested hold to rigid means; test solution.

Preparation of the materials: the samples must be conditioned at room temperature (20±3° C.) for at least 4 hours before the commencement of the test.

Procedure: (1) fill the container with the product to the level to be seen in the final package and secure the mechanical pump dispenser to the container; (2) prime the pump dispenser by actuating it until a full discharge of product occurs; (3) place the package on the balance and tare the weight to zero; (4) actuate the pump dispenser ten (10) times by hand (60 strokes per minute)—NOTE: care must be taken to use the full stroke on each actuation; (5) reweight the package and record the value to the nearest 0.01 as appropriate for the balance used and record; (6) repeat steps (1)-(5) for a minimum of 3 (three) packages, (7) report the following information: (a) description of the mechanical pump dispenser and product tested, (b) number of specimen tested, (c) mean value and standard deviation of the weight per pump.

Pump Average Peak Force to Actuate & Return Time.

Equipment and materials: (1) force meter: Instron® 8500; (2) at least 5 pump dispensers.

Preparation: condition the samples for 24 hours at room temperature (20±3° C.).

Procedure: (1) fill the container with the liquid product being tested to the level to be seen in the final package and secure the mechanical pump dispenser to the container; (2) place the pump package in the force meter; (3) actuate the pump 5 times at 90% full stroke at 200 mm/sec head speed, measure and record the peak force each time; the recovery rate of the force instrument should be faster than that of the pump head i.e. the instrument should not keep in contact with the pump head while the pump is recovering; use an high speed camera to determine the return time; (4) calculate the average peak force, (5) repeat steps (1)-(4) for a minimum of 3 packages, (6) report the following information: (a) description of the mechanical pump dispenser and product tested, (b) number of specimen tested, (c) mean value and standard deviation of the average force to actuate per pump.

Spring Specifications and Average Peak Force to Actuate

Equipment and materials: (1) force meter: Instron® 8500; (2) Vernier caliper (±0.1 mm), (3) at least 5 springs specimen per type (for the force test)

Preparation: condition the spring specimen for 24 hours at room temperature (20±3° C.).

Procedure:

The Free Height (F) is the height of the spring without any load applied and is determined by placing a straightedge across the top of the spring and measuring the perpendicular distance from the plate on which the spring stands to the bottom of the straightedge at the approximate center of the spring with the Vernier caliper.

The Spring Length Preloaded (P) is the height of the spring when assembled in the pump in the storage (rest) configuration i.e. when the pump is not actuated. This can be measured from the pump footprint or using x-ray or CT scan. The Spring Preload (PL) is calculated subtracting the Spring Length Preloaded from the Free Height.

The Full Stroke (FS) is the spring deflection measured when the spring is assembled in the pump and experiencing the maximum compression during pump operation. The Test stroke (TS) is calculated to be 90% of the Full Stroke (FS). The Test deflection (TD) is calculated by adding the Test Stroke (TS) to the Spring Preload (PL).

The Spring Force at test deflection is measured by securing the spring on a force tester mounting supports ensuring that the spring ends are parallel, and the spring is not loaded. The entire set-up should be in a protective cage for safety. Load the spring by a suitable weight using the force tester and note the corresponding axial compression. Increase the load and take the corresponding axial deflection readings. Plot the curve between load and deflection. The Spring Force at test deflection reported corresponds to an axial deflection equal to the Test deflection (TD) height.

Combinations

A. A pump dispenser comprising:

a) a bottle comprising a neck having a neck landing zone; wherein the bottle consists essentially of polypropylene, polyethylene, or polyethylene terephthalate;

b) a pump assembly comprising:

i) a pump head having a cavity therein wherein the pump head is adapted to receive an end of a first stem;

ii) a closure coupled to the neck of the body;

iii) the first stem comprising an end rigidly connected to the pump head, a hollow inner cavity fluidly connected to the pump head cavity, and an outer surface having a first snap and a second snap; wherein the first stem is configured to move relative to a second stem;

iv) the second stem at least partially enclosing the first stem; the second stem having a hollow inner channel in fluid communication with the first stem inner cavity; wherein the second stem comprises a platform and a cantilever; wherein the cantilever interlocks with the first snap in a locked storage position and the second snap in a dispense ready position;

v) a plastic spring at least partially surrounding the second stem;

vi) a housing at least partially surrounding the spring; the housing comprising a dosing chamber having a hollow interior wherein the hollow interior is in fluid communication with the inner channel of the second stem;

wherein the pump assembly consists essentially of polypropylene or polyethylene.

B. A pump dispenser comprising:

a) a bottle comprising a neck having a neck landing zone wherein the bottle contains a fluid product;

b) a pump assembly in a locked storage configuration comprising:

i) a pump head having a cavity therein wherein the pump head is adapted to receive an end of a first stem;

ii) a closure coupled to the neck of the body;

iii) the first stem comprising an end rigidly connected to the pump head, a hollow inner cavity fluidly connected to the pump head cavity, and an outer surface having a first snap; wherein the first stem is configured to move relative to a second stem;

iv) the second stem at least partially enclosing the first stem; the second stem having a hollow inner channel in fluid communication with the first stem inner cavity; wherein the second stem comprises a platform and a cantilever; wherein the cantilever interlocks with the first snap;

v) a plastic spring at least partially surrounding the second stem; wherein there is no preload on the spring and the spring is adjacent to and spaced from the platform;

vi) a housing at least partially surrounding the spring; the housing comprising an inner wall and a dosing chamber having a hollow interior wherein the hollow interior is in fluid communication with the inner channel of the second stem;

wherein the pump assembly comprises at least 80% of one kind of recyclable plastic selected from the group consisting of polyethylene, polypropylene, polyethylene terephthalate, and combinations thereof.

C. The pump dispenser according to Paragraphs A-B, wherein the distance from the neck landing zone to a top of the pump head is less than 25 mm, preferably less than or equal to 23 mm, more preferably less than 22 mm, and even more preferably less than or equal to 20 mm.

D. The pump dispenser according to Paragraphs A-C, wherein the plastic spring comprising a design selected from the group consisting of single helix, double helix, stacked double helix, wave spring, and combinations thereof.

E. The pump dispenser according to Paragraphs A-D, wherein the housing comprising a first housing and a second separate housing; wherein the first housing partially surrounds the spring and the second housing comprises the dosing chamber.

F. The pump dispenser according to Paragraphs A-E, wherein the pump head further comprises threads coupled to mating threads on an outer surface of the closure.

G. The pump dispenser according to Paragraphs A-F, wherein the plastic spring is not in contact with the fluid product in the locked storage configuration.

H. The pump dispenser according to Paragraphs A-G, wherein the plastic spring is not pre-loaded in the locked storage configuration.

I. The pump dispenser according to Paragraphs A-H, wherein the pump dispenser comprises at least 90% of one kind of recyclable plastic selected from the group consisting of polyethylene, polypropylene, polyethylene terephthalate, and combinations thereof.

J. The pump dispenser according to Paragraphs A-I, wherein the pump dispenser comprises at least 95% of one kind of recyclable plastic selected from the group consisting of polyethylene, polypropylene, polyethylene terephthalate, and combinations thereof.

K. The pump dispenser according to Paragraphs A-J, wherein the pump head further comprises pump head threads and the closure further comprises mating closure threads wherein the pump head threads are threadingly engaged to the mating closure threads.

L. according to Paragraphs A-K, where the inner wall of the housing comprises one or more retention features adapted to engage a surface of the second stem.

M. A method of dispensing the liquid product from the pump dispenser according to Paragraphs A-L, comprising:

a) disengaging the cantilever from the first snap;

b) engaging the cantilever with the second snap;

c) pressing the pump head downwards from about 1 to about 10 times to prime the pump assembly;

d) pressing the pump head, thereby compressing the spring, to dispense the liquid product from the pump dispenser.

N. The method according to Paragraph M, wherein the pump dispenses from about 2 mL to about 6 mL of the liquid product per pumping action, preferably =from about 2.5 to about 5.5 ml, more preferably about 3 to about 5 ml, and even more preferably from about 3.6 to about 4.4 ml.

O. The method according to Paragraphs M-N, wherein the pump assembly comprises a peak force to actuate at 90% stroke of less than 40 N, preferably less than 35 N, and more preferably less than 30 N, as determined by the Average Peak Force to Actuate Test Method using water, described herein.

P. The method according to Paragraphs M-O, wherein the plastic spring is not in contact with the fluid product during dispensing.

Q. The method according to Paragraphs M-P, wherein the inner wall of the housing further comprises one or more retention features adapted to engage a surface of the second stem and the spring is partially compressed after priming and/or dispensing.

R. The method according to Paragraphs M-Q, wherein the pump head further comprises pump head threads and the closure further comprises mating closure threads wherein the pump head threads are threadingly engaged to the mating closure threads and the pump head is rotated to disengage the pump head threads either concurrently or before step (a).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as “40 mm” is intended to mean “about 40 mm”.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A pump dispenser comprising:

a) a bottle comprising a neck having a neck landing zone; wherein the bottle consists essentially of polypropylene, polyethylene, or polyethylene terephthalate;

b) a pump assembly comprising:

i) a pump head having a cavity therein wherein the pump head is adapted to receive an end of a first stem;

ii) a closure coupled to the neck;

iii) the first stem comprising an end rigidly connected to the pump head, a hollow inner cavity fluidly connected to the pump head cavity, and an outer surface having a first snap and a second snap; wherein the first stem is configured to move relative to a second stem;

iv) the second stem at least partially enclosing the first stem; the second stem having a hollow inner channel in fluid communication with the first stem inner cavity; wherein the second stem comprises a platform and a cantilever; wherein the cantilever interlocks with the first snap in a locked storage position and the second snap in a dispense ready position;

v) a plastic spring at least partially surrounding the second stem;

vi) a housing at least partially surrounding the spring; the housing comprising a dosing chamber having a hollow interior wherein the hollow interior is in fluid communication with the inner channel of the second stem;

wherein the pump assembly consists essentially of polypropylene or polyethylene.

2. The pump dispenser of claim 1, wherein the distance from a neck landing zone to a top of the pump head is less than 25 mm.

3. The pump dispenser of claim 1, wherein the plastic spring comprising a design selected from the group consisting of single helix, double helix, stacked double helix, wave spring, and combinations thereof.

4. The pump dispenser of claim 1, wherein the housing comprising a first housing and a second separate housing; wherein the first housing partially surrounds the spring and the second housing comprises the dosing chamber.

5. A pump dispenser comprising:

a) a bottle comprising a neck wherein the bottle contains a fluid liquid product;

b) a pump assembly in a locked storage configuration comprising:

i) a pump head having a cavity therein wherein the pump head is adapted to receive an end of a first stem;

ii) a closure coupled to the neck;

iii) the first stem comprising an end rigidly connected to the pump head, a hollow inner cavity fluidly connected to the pump head cavity, and an outer surface having a first snap; wherein the first stem is configured to move relative to a second stem;

iv) the second stem at least partially enclosing the first stem; the second stem having a hollow inner channel in fluid communication with the first stem inner cavity; wherein the second stem comprises a platform and a cantilever; wherein the cantilever interlocks with the first snap;

v) a plastic spring at least partially surrounding the second stem; wherein there is no preload on the spring and the spring is adjacent to and spaced from the platform;

vi) a housing at least partially surrounding the spring; the housing comprising an inner wall and a dosing chamber having a hollow interior wherein the hollow interior is in fluid communication with the inner channel of the second stem; wherein the pump assembly comprises at least 80% of one kind of recyclable plastic selected from the group consisting of polyethylene, polypropylene, polyethylene terephthalate, and combinations thereof.

6. The pump dispenser of claim 5, wherein the pump head further comprises threads engaged with mating closure threads of the closure.

7. The pump dispenser of claim 5, wherein the plastic spring is not in contact with the liquid product in the locked storage configuration.

8. The pump dispenser of claim 5, wherein the plastic spring is not pre-loaded in the locked storage configuration.

9. The pump dispenser of claim 5, wherein the pump dispenser comprises at least 90% of one kind of recyclable plastic selected from the group consisting of polyethylene, polypropylene, polyethylene terephthalate, and combinations thereof.

10. The pump dispenser of claim 9, wherein the pump dispenser comprises at least 95% of one kind of recyclable plastic selected from the group consisting of polyethylene, polypropylene, polyethylene terephthalate, and combinations thereof.

11. The pump dispenser of claim 5, wherein the pump head further comprises pump head threads and the closure further comprises mating closure threads wherein the pump head threads are threadingly engaged to the mating closure threads.

12. The pump dispenser of claim 5, where the inner wall of the housing comprises one or more retention features adapted to engage a surface of the second stem.

13. A method of dispensing the liquid product from the pump dispenser of claim 5, comprising:

a) disengaging the cantilever from the first snap;

b) engaging the cantilever with a second snap;

c) pressing the pump head downwards from about 1 to about 10 times to prime the pump assembly;

d) pressing the pump head, thereby compressing the spring, to dispense the liquid product from the pump dispenser.

14. The method of claim 13, wherein the pump dispenses from 2 mL to 6 mL of the liquid product per pumping action.

15. The method of claim 13, wherein the pump assembly comprises a peak force to actuate at 90% stroke of less than 40 N.

16. The method of claim 15, wherein the pump assembly comprises a peak force to actuate at 90% stroke of less than or equal to 30 N.

17. The method of claim 13, wherein the plastic spring is not in contact with the liquid product during dispensing.

18. The method of claim 13, wherein the inner wall of the housing further comprises one or more retention features adapted to engage a surface of the second stem and the spring is partially compressed after priming and/or dispensing.

19. The method of claim 13, wherein the pump head further comprises pump head threads and the closure further comprises mating closure threads wherein the pump head threads are threadingly engaged to the mating closure threads and the pump head is rotated to disengage the pump head threads either concurrently or before step (a).

* * * * *